US007827719B2

(12) United States Patent
McGarry

(10) Patent No.: US 7,827,719 B2
(45) Date of Patent: Nov. 9, 2010

(54) REVERSIBLE BACKSTRAP FOR FIREARM

(75) Inventor: James McGarry, Prescott Valley, AZ (US)

(73) Assignee: Sturm, Ruger & Company, Inc., Southport, CT (US)

( * ) Notice: Subject to any disclaimer, the term of this patent is extended or adjusted under 35 U.S.C. 154(b) by 689 days.

(21) Appl. No.: 11/881,111

(22) Filed: Jul. 25, 2007

(65) Prior Publication Data

US 2010/0212203 A1 Aug. 26, 2010

(51) Int. Cl.
*F41A 17/00* (2006.01)

(52) U.S. Cl. ..... 42/70.01; 42/7; 42/72; 89/1.42

(58) Field of Classification Search ..... 42/7, 42/71.01–71.02, 72, 73, 90, 70.01; 89/1.42
See application file for complete search history.

(56) References Cited

U.S. PATENT DOCUMENTS

| | | | | |
|---|---|---|---|---|
| 4,043,066 | A | 8/1977 | Pachmayr et al. | |
| 4,286,401 | A | 9/1981 | Pachmayr et al. | |
| 4,570,370 | A | 2/1986 | Smith et al. | |
| 5,797,207 | A | 8/1998 | Marable et al. | |
| 6,112,446 | A * | 9/2000 | Forster et al. | 42/71.02 |
| 7,506,469 | B2 * | 3/2009 | Poulin et al. | 42/71.02 |
| 7,587,852 | B1 * | 9/2009 | Harms | 42/71.02 |
| 2006/0096147 | A1 * | 5/2006 | Gussalli Beretta | 42/71.02 |
| 2007/0256347 | A1 * | 11/2007 | Fitzpatrick et al. | 42/96 |

OTHER PUBLICATIONS

Author Unknown, FNP/Browning PRO-9 pistol (Belgium/USA), world.guns.ru/handguns/hg129-e.htm, Jun. 20, 2007.
Author Unknown,Browning Pro Series Pistols, Shooting Times, www.shootingtimes.com/newproducts/browning_1030/, Mar. 20, 2007.
Gary Paul Johnston, New Walther P99 9mm, www.remtek.com/arms/walther/model/p99/index.htm, (first published Jul. 1997 edition of Guns & Weapons for Law Enforcement), Mar. 20, 2007.
Author Unknown, M&P Series, www.smith-wesson.com, date unknown.
Raunch, Walt, The FNP 9 and FNP 9M, Handguns Magazine, Jun. 21, 2007, www.handgunsmag.com.

* cited by examiner

*Primary Examiner*—J. Woodrow Eldred
*Assistant Examiner*—Gabriel J Klein
(74) *Attorney, Agent, or Firm*—Duane Morris LLP; Frank J. Spanitz

(57) ABSTRACT

A firearm with reversible backstrap and method of use. The firearm in one embodiment includes a frame defining a grip and a cavity therein, and a backstrap insert that is removably positioned in the cavity. The insert includes first and second backstrap grip surfaces that are each respectively disposed on opposite portions of the backstrap insert, such as a front portion and a rear portion in one embodiment. Preferably, the second backstrap grip surface is different than the first grip surface in some characteristic, such as thickness, profile or shape, material of construction, surface texture, etc. In one embodiment, the position of the insert may be reversed in the frame to selectively reverse the orientation of the first and second grip surfaces between front-facing and rear-facing in some embodiments to provide a user with a choice of grip surfaces. In some embodiments, this allows the user to change the grip depth of the firearm.

24 Claims, 24 Drawing Sheets

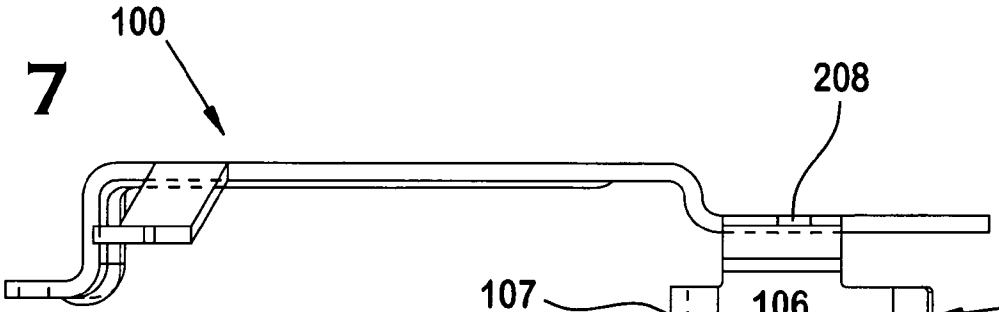
FIG. 7
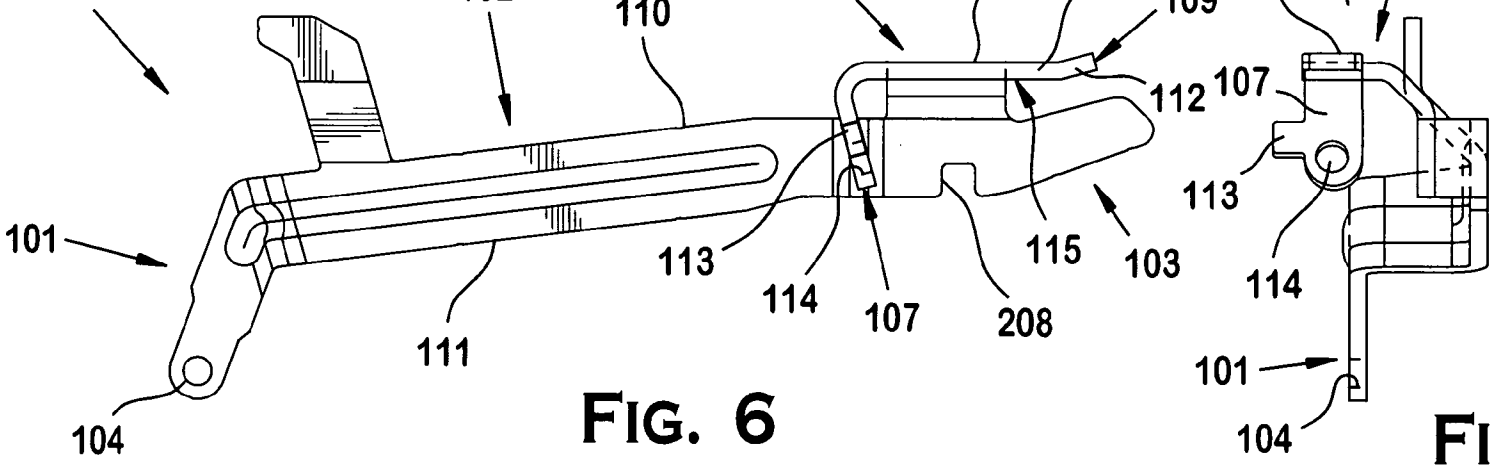
FIG. 6
FIG. 8

FIG. 15
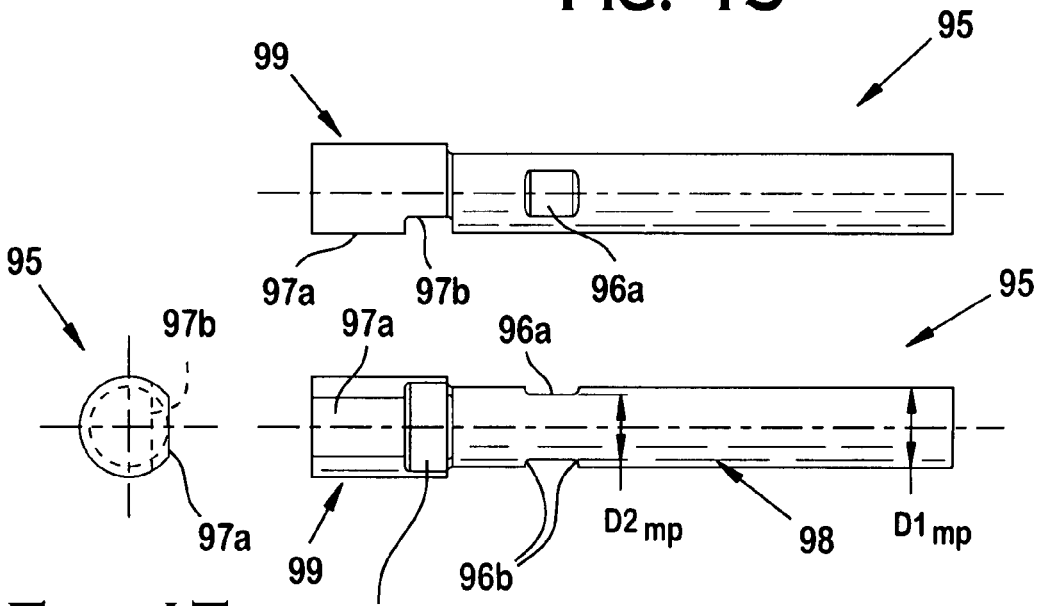
FIG. 17
FIG. 16
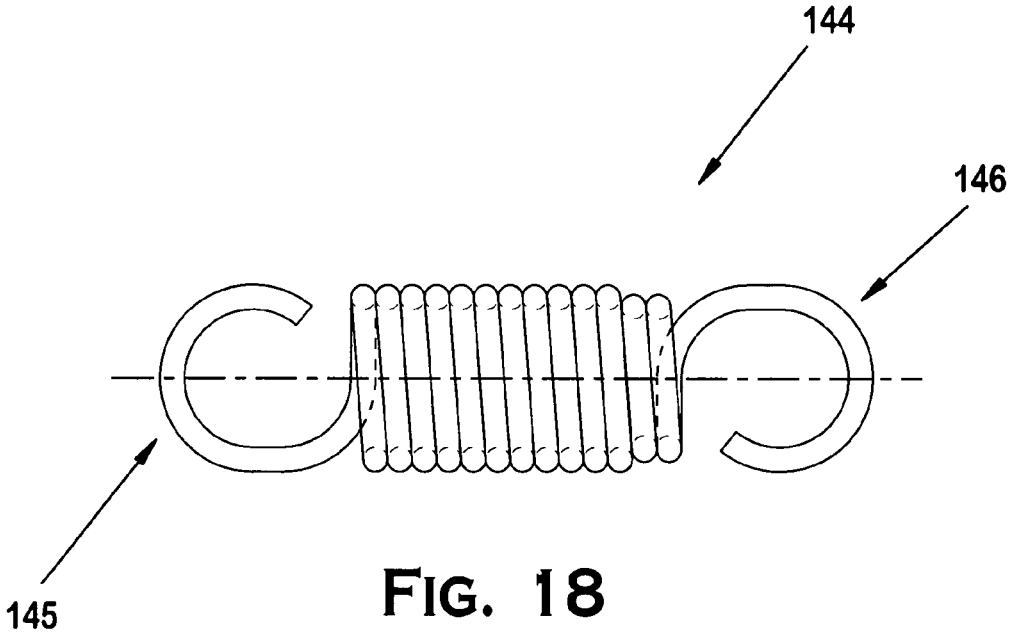
FIG. 18

REVERSIBLE BACKSTRAP FOR FIREARM

BACKGROUND OF THE INVENTION

The present invention generally relates to firearms, and more particularly to a reversible backstrap for the grip of a firearm such as a pistol.

Firearms such as semi-automatic pistols generally include a frame, a barrel that defines a chamber for holding a cartridge, a reciprocating slide that defines a breech face on the front for engaging the rear of the chamber; and a spring-loaded axially-movable firing pin disposed in the slide that contacts the cartridge to discharge the pistol. When the pistol is discharged, the slide recoils rearward with respect to the frame and then returns forward to open and close the action. There are various design approaches to firing control mechanisms for striking the cartridge with the firing pin.

One type of firearm has a firing control mechanism that cocks and releases a hammer via a trigger pull to strike the firing pin. The firing pin is driven forward by the hammer and contacts the cartridge. Another type of firearm commonly referred to as "striker-fired" has a firing control mechanism that eliminates the hammer and operates by directly cocking and releasing the firing pin, which is also referred to as a "striker" in these type mechanisms. In contrast to firing control mechanisms having hammers which may have an external spur for manual cocking, the striker is completely internal to the firearm. A firing control mechanism for a striker-fired pistol generally includes a trigger, a movable trigger bar actuated by the trigger, a striker-type striker having a protrusion for operably cocking and holding the striker in a ready-to-fire position; a striker biasing spring; and a striker cocking/release mechanism. The cocking/release mechanism typically includes a striker catch that engages the striker protrusion to cock and hold the striker in a ready-to-fire cocked position, and then disengages the protrusion via a trigger pull to release the striker and discharge the pistol. United States Patent Application Publication No. 2006/0248772 shows one design for a striker catch in the form of a sear that is actuated by the trigger and is engageable with the striker protrusion for cocking and releasing the striker. Additional components such as a sear, however, add to the complexity and cost of the firing mechanism for a striker-fired firearm. Other striker cocking mechanisms may utilize different types of striker catches or similar mechanisms for cocking, holding, and releasing the striker.

Regardless of the type of striker catch or similar mechanism utilized, the striker catch is typically positioned in the forward path of and in relative longitudinal axial alignment with the striker protrusion to catch the striker upon the forward return movement of the slide (with striker therein) after discharging the firearm. The striker is held in the cocked position by the catch, and remains ready for the next trigger pull which disengages the striker catch from the protrusion to discharge the firearm. In order to field strip the firearm for maintenance, however, the slide in some designs must be slid forward on the frame past the striker catch in order to be removed. Accordingly, it is necessary to displace the striker catch by some means so that the striker protrusion can clear the catch to allow removal of the slide from the firearm frame. An improved and mechanically simple firing control and slide removal mechanism is therefore desired.

According to another aspect of striker-fired firearm design, it is desirable to have a lockable manual safety mechanism to disable the firing control mechanism. An improved and mechanically simple lockable manual safety mechanism is therefore also desired.

According to another aspect of general firearm design, pistol and accessory manufacturers have recognized that a single pistol grip size may not fit all users' hands. Several approaches have been used to address this situation. One approach employed by some accessory manufacturers is to provide complete replacement grips of varying sizes. Another approach taken by some firearm manufacturers is to provide a set of user-replaceable backstraps of differing sizes that the user can swap out typically with simple tools such as a punch. The backstraps alter the depth of the grip to fit the size preferences of a particular user. The backstraps sets, however, have drawbacks. Since the extra backstraps are not a permanent part of the pistol, they are cumbersome to carry and may easily be misplaced, lost, or not carried into the field with the user. In the event that the user desires to change the size of the grip (e.g., to accommodate more than one shooter with different grip size preferences on a given occasion), the extra backstraps may thus simply not be available. Accordingly, an improved and convenient backstrap system for altering the size and type of grip is also desirable.

SUMMARY OF THE INVENTION

According to one embodiment, a firearm with reversible grip backstrap includes a frame defining a grip and a cavity, and a backstrap insert removably positioned in the cavity. The insert preferably includes a first backstrap grip surface and a second backstrap grip surface, which in some embodiments is preferably different than the first grip surface in some characteristic, such as thickness, profile or shape, material of construction, surface texture, etc. The position of the insert is reversible to alternate orientation of the first and second grip surfaces. In one embodiment, the backstrap insert has a first position in which the first grip surface is oriented to face forward and the second grip surface is oriented to face rearward. The cavity preferably includes a rear-facing window so that the first or second grip surfaces may project through the window. In one embodiment, the second grip surface projects rearward and outwards from the cavity, and the first grip surface faces forward and inwards towards the cavity.

In one possible embodiment, the backstrap insert has an asymmetrical shape defined by the first and second grip surfaces. Preferably, the first and second grip surfaces are disposed on opposite front and rear sides of the backstrap insert respectively. The first and second grip surfaces in some embodiments define respective different thicknesses, the first and second grip surfaces having a first orientation when the insert is positioned in the frame thereby defining a first grip depth. In another embodiment, the first and second grip surfaces have a second orientation when the insert is positioned in the frame thereby defining a second grip depth different than the first grip depth.

In other possible embodiments, the first grip surface may be convex in profile and the second grip surface may be substantially flat in profile. The first grip surface preferably may be ribbed or serrated in some embodiments. In one embodiment, the backstrap insert is made of an elastomeric material.

According to another embodiment, a firearm with reversible grip backstrap includes: a frame defining a grip and a cavity; and a backstrap insert including a first backstrap grip surface and a second backstrap grip surface disposed on opposite portions of the insert. The first grip surface preferably may be different than the second grip surface. In one embodiment, the first grip surface is substantially flat in side profile and the second grip surface is substantially convex in side profile. The backstrap insert preferably is removably positioned in the cavity and defines a first orientation wherein the first grip surface faces forward and the second grip surface faces rearward. Reversing the position of backstrap insert in the cavity preferably defines a second orientation wherein the first grip surface faces rearward and the second grip surface faces forward. In a preferred embodiment, the backstrap insert in the second orientation is rotated 180 degrees from the first orientation.

In one embodiment, the first and second orientations of the backstrap insert each define respective first and second grip depths, the second grip depth being different than the first grip depth. In one embodiment, the second grip depth is smaller than the first grip depth.

According to another embodiment, a firearm with reversible backstrap includes: a grip frame having a depth and defining a backstrap cavity; and a backstrap insert removably positioned in the cavity in a first position. The insert includes a first backstrap grip surface and a second backstrap grip surface disposed on opposite front and rear portions of the insert respectively. In one embodiment, the first grip surface defines a first side profile and a first thickness and the second grip surface defines a second side profile and a second thickness different than the first thickness such that reversing the position of the insert in the cavity to a second position changes the depth of the grip. In one embodiment, the first grip surface may be substantially convex in profile and the second grip surface may be substantially flat in profile.

According to another embodiment, a reversible backstrap grip insert for a firearm includes: an elongate body defining opposite front and rear portions; a first backstrap grip surface disposed on the front portion of the body; and a second backstrap grip surface disposed on the rear portion of the body. Preferably, in some embodiments, the second grip surface is different than the first grip surface. In a preferred embodiment, the position of the insert is reversible when installed in the firearm to allow a user to select one of the first and second grip surfaces. In one embodiment, the first grip surface defines a first thickness and the second grip surface defines a second thickness different than the first thickness. In another embodiment, the first grip surface has a surface texture different than the second grip surface. In yet another embodiment, the second grip surface has a generally flat side profile and the first grip surface may have a convex side profile or another side profile different than the profile of the second grip surface. In one embodiment, the first grip surface preferably faces in a direction opposite the second grip surface to provide the user with a choice of two different grip surfaces and/or profiles.

According to another embodiment, a reversible backstrap grip insert for a firearm includes: an elongate body that is configured to be received in a complementary-shaped cavity in the grip frame of the firearm, the body defining front and rear portions and opposite sides extending between the front and rear portions; a first backstrap grip surface disposed on the front portion of the body and facing in a first direction; and a second backstrap grip surface disposed on the rear portion of the body and facing in a second direction opposite the first direction, the second grip surface being different than the first grip surface. Preferably, the position of the insert is reversible when installed in the firearm to allow a user to select one of the first and second grip surfaces.

A method of changing the backstrap of a firearm is also provided. According to one embodiment, the method includes: removing a backstrap insert from a firearm; rotating the backstrap insert; and reinserting the backstrap insert into the firearm. In one embodiment, the rotating step includes rotating the backstrap insert so that a first grip surface of the backstrap insert faces in a direction opposite to a direction of the first grip surface before the backstrap insert is rotated. In another embodiment, the first grip surface faces in a forward direction before rotation and in a rearward direction after rotation of the backstrap insert. In another embodiment, the backstrap insert includes a first grip surface and a second grip surface disposed on a portion of the backstrap insert opposite to the first grip surface. In another embodiment, the rotating step includes rotating the backstrap insert 180 degrees.

According to another embodiment, a method of changing the backstrap of a firearm includes: positioning a backstrap insert in a firearm; exposing a first grip surface defined by the backstrap insert to a user; removing the backstrap insert from the firearm; rotating the backstrap insert; and exposing a second grip surface defined by the backstrap insert to the user. In one embodiment, the first and second grip surfaces are disposed on opposite portions of the backstrap insert, with one portion being a front portion and the other portion being a rear portion of the backstrap insert. In another embodiment, the first and second grip surfaces are preferably different from each other in thickness, side profile, surface textures, and/or type of material of construction. In one embodiment, the first grip surface has a flat side profile and the second grip surface has a convex side profile. In another embodiment, the method further includes concealing the first grip surface from the user when exposing the second grip surface.

According to another embodiment, a method of changing the backstrap of a firearm includes: positioning a backstrap insert in a frame of a firearm; projecting a first grip surface on the backstrap insert outwards from the frame; removing the backstrap insert from the firearm; rotating the backstrap insert; and projecting a second grip surface on the backstrap insert outwards from the frame. In one embodiment, rotating the backstrap insert changes a grip depth of the firearm. In another embodiment, the first grip surface is different than the second grip surface. In one embodiment, the first grip surface is substantially flat in side profile and the second grip surface is at least slightly bulbous in side profile. In another embodiment, the first and second grip surfaces are disposed on opposite front and rear portions of the backstrap insert.

BRIEF DESCRIPTION OF THE DRAWINGS

The features of the preferred embodiments will be described with reference to the following drawings where like elements are labeled similarly, and in which:

FIG. 6 is a side view of the trigger bar of the pistol of FIG. 1;

FIG. 7 is a top view of the trigger bar of FIG. 6;

FIG. 8 is a rear view of the trigger bar of FIG. 6;

FIG. 15 is a top view of a firing control housing mounting pin of the pistol shown in FIG. 1;

FIG. 16 is a rear view of the firing control housing mounting pin of FIG. 15;

FIG. 17 is an end view of the firing control housing mounting pin of FIG. 15;

FIG. 18 is a side view of a trigger bar tensioning spring of the pistol of FIG. 1;

DESCRIPTION OF PREFERRED EMBODIMENTS

Figure 1A:
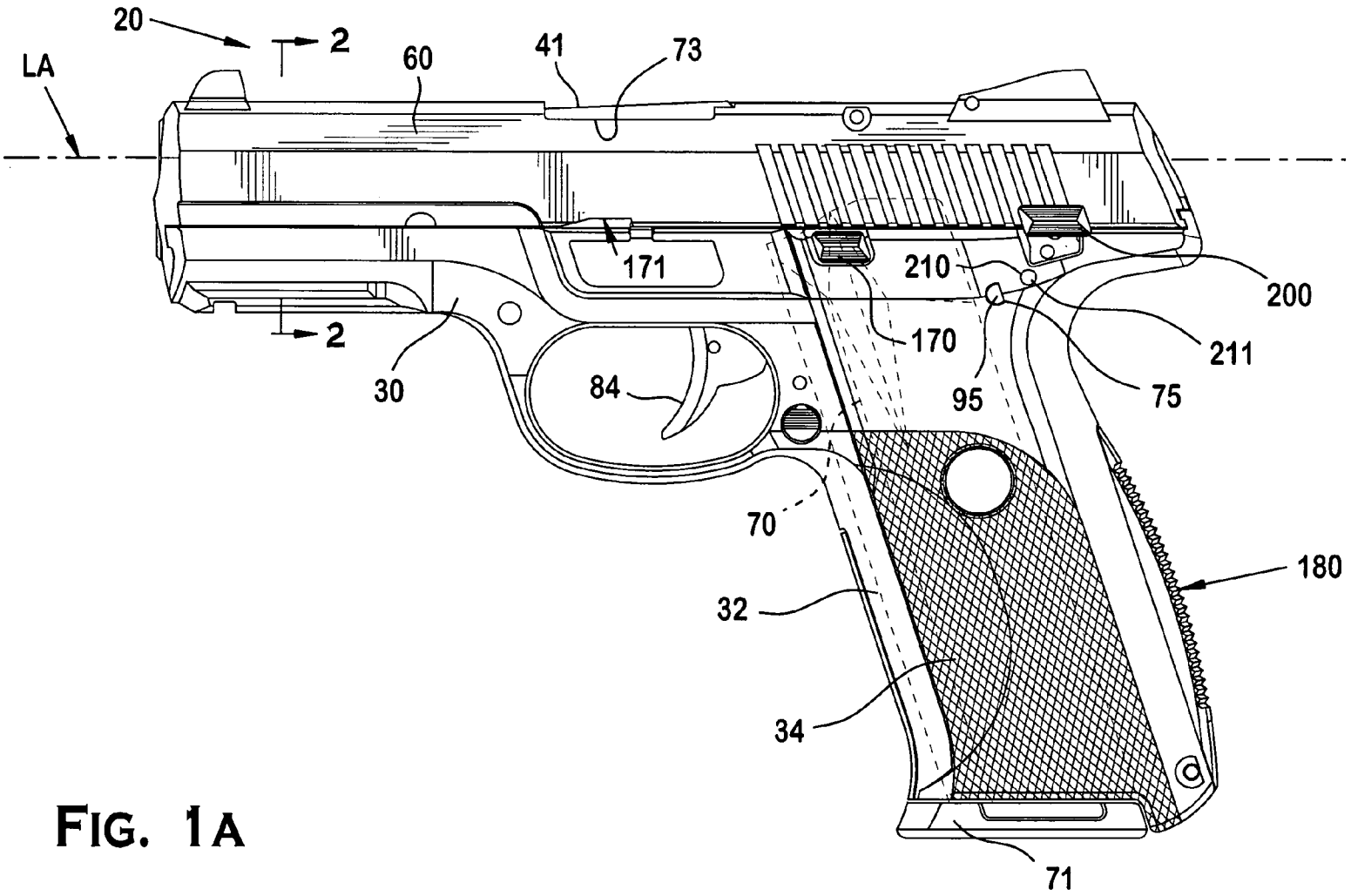
FIG. 1A is a side view of one embodiment of a striker-fired pistol according to principles of the present invention.

The features and benefits of the invention are illustrated and described herein by reference to preferred embodiments. This description of preferred embodiments is intended to be read in connection with the accompanying drawings, which are to be considered part of the entire written description. In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected" and "interconnected," refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

A preferred embodiment will now be described for convenience with reference and without limitation to a striker-fired firearm in the form of an autoloading pistol. The principles and features disclosed herein may be used with equal advantage for other types of firearms, such as without limitation rifles.

Figure 1B:
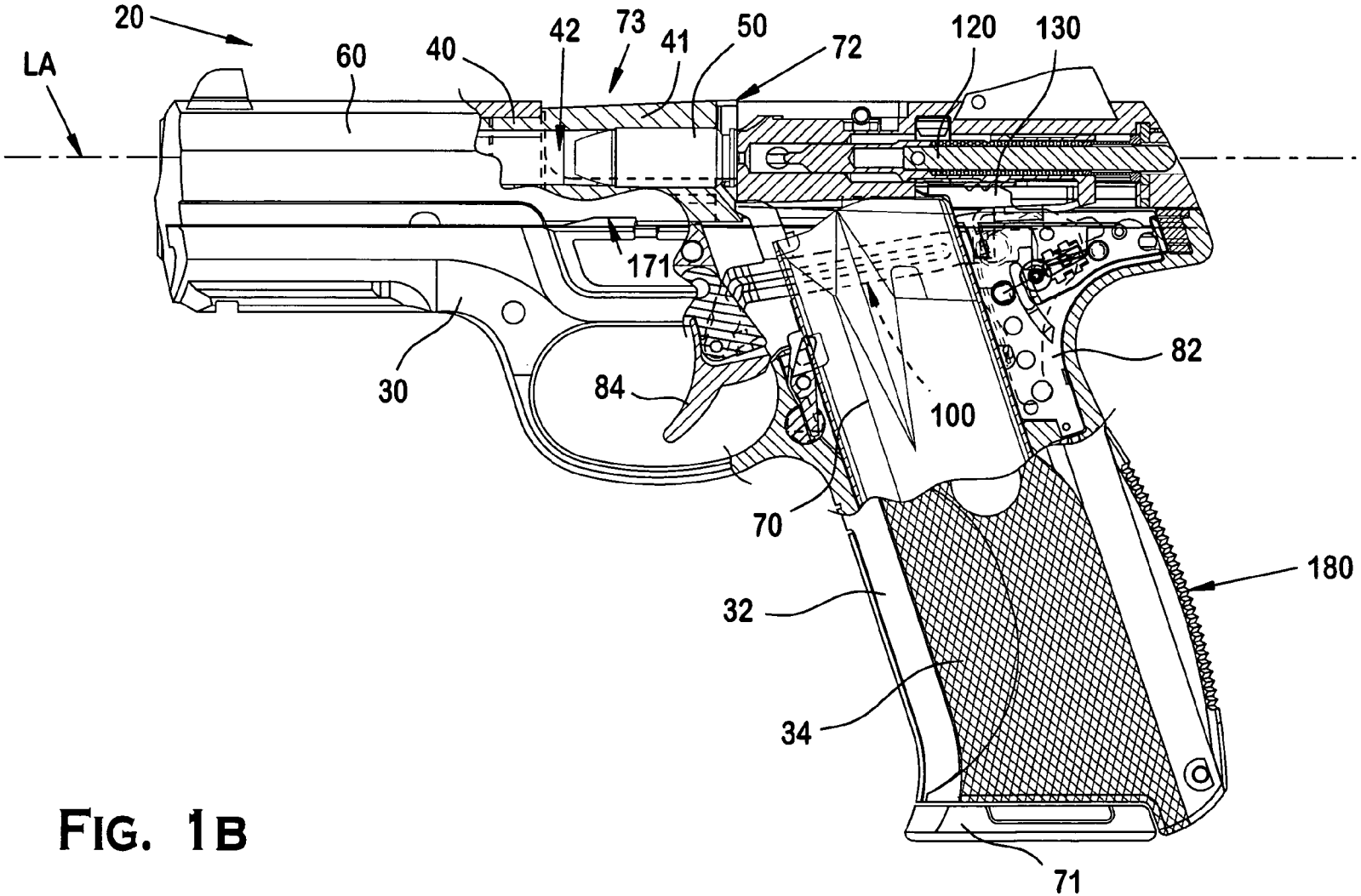
FIG. 1B is a side view of the pistol of FIG. 1A with a portion cut away to reveal the firing control mechanism.
Figure 2:
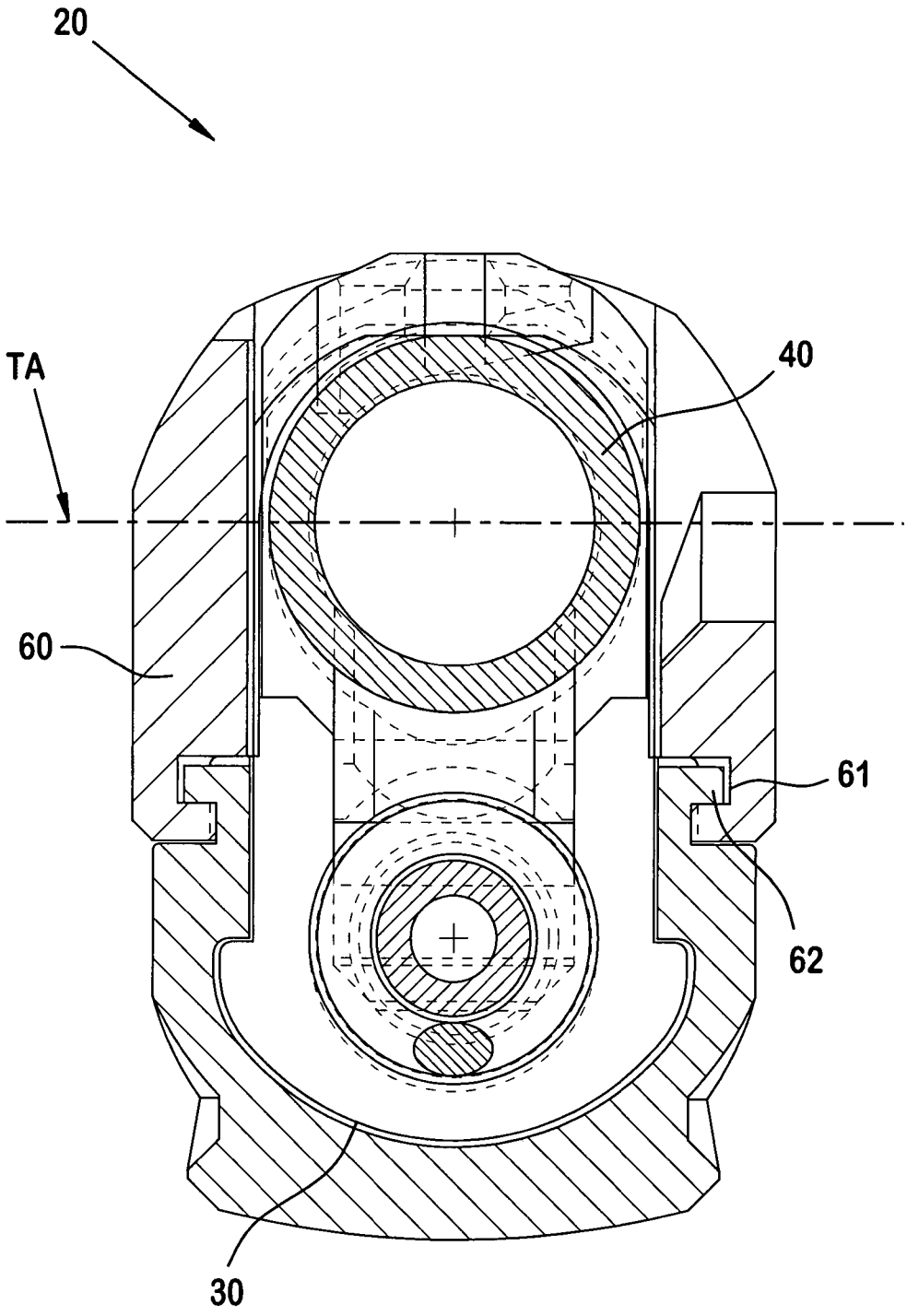
FIG. 2 is a cross-sectional view through the front of the pistol of FIG. 1 taken along line 2-2.

Referring to FIGS. 1A, 1B, and 2, a striker-fired autoloading pistol 20 generally includes a frame 30 defining a longitudinal axis LA and transverse axis TA (see FIG. 2) disposed perpendicular thereto, a barrel 40 including a chamber block 41 defining an internal chamber 42 open at a rear portion thereof for receiving a cartridge 50, and a reciprocating slide 60 movably supported and guided by the frame for axial movement in forward and rearward directions along the longitudinal axis. Slide 60 defines a breech face on the front of the slide that is engageable with the rear of chamber block 41 and which further defines an openable/closeable breech area 72 between the breech face and chamber block rear (see FIG. 1B). Slide 60 includes an ejection port 73 to allow spent cartridge casings to be engaged by and expelled from the pistol after firing by an ejector 130 described further herein. After pistol 20 is fired or discharged, recoil forces cause barrel 40 and slide 60 to travel rearwards for a distance due with the breech face remaining engaged with the rear of chamber block 41 (i.e., breach area 72 remains closed). Rearward movement of barrel 40 is then arrested by a cam mechanism (not shown) in one embodiment, while slide 60 uncouples from the barrel and continues to travel rearwards separately thereby opening up the action (i.e., breech area 72). The spent casing of cartridge 50 is then engaged by ejector 130 and expelled through ejection port 73. Slide 60 is then returned forward by a recoil spring (not shown) and strips a new cartridge from magazine 70 which is automatically fed into chamber 42 whereupon the slide is recoupled to barrel 40 and breech area 72 becomes closed again (i.e. breech face on slide 60 re-engages rear of chamber block 41).

Frame 30 defines a grip frame 32 having a hand grip 34 mounted on either side. Grip frame 32 defines a downwardly-open magazine cavity 36 extending between a front grip frame wall 33 and rear grip frame wall 35. Magazine cavity 36 preferably is configured to removably and slidably receive complementary-shaped magazine 70 capable of holding and dispensing a plurality of cartridges 50 for automatic loading of pistol 20. Magazine 70 includes a baseplate or footplate 71 affixed to the bottom of the magazine which may remain outside of magazine cavity 36 below grip frame 32 when the magazine is fully inserted in the pistol as shown.

In one embodiment, slide 60 is slidably engaged with frame 30 via a rail and channel system to provide support and guided reciprocating movement of the slide. Referring to FIG. 2, slide 60 includes laterally spaced-apart and longitudinally-extending channels 61 that in one embodiment open inwards towards each other. Channels 61 slidably engage a pair of complementary-shaped laterally spaced-apart and longitudinally-extending rails 62 on frame 30. The rails 62 and/or channels 61 extend at least partially along the longitudinal length of frame 30 and slide 60, respectively. In addition, rails 62 and channels 61 may include continuous or intermittent portions disposed along the longitudinal axis LA of the pistol. The rail-channel system provides guided movement of the slide 60 along the frame 30 during rearward and forward reciprocating motion of the slide after firing pistol 20 or when the slide is moved manually by a user to either open the action (i.e. breech area 72) of the pistol and/or to remove and dismount the slide from the frame. Slide 60 is axially moveable along longitudinal axis LA from a first forward position associated with the point at which the slide channels 61 may be disengaged from frame rails 62 to remove the slide from the frame 30, to a second rearward position along longitudinal axis LA. The first forward or slide removal longitudinal position in some embodiments may be farther forward than the longitudinal position ordinarily reached by slide 60 after discharging the firearm.

Figure 3:
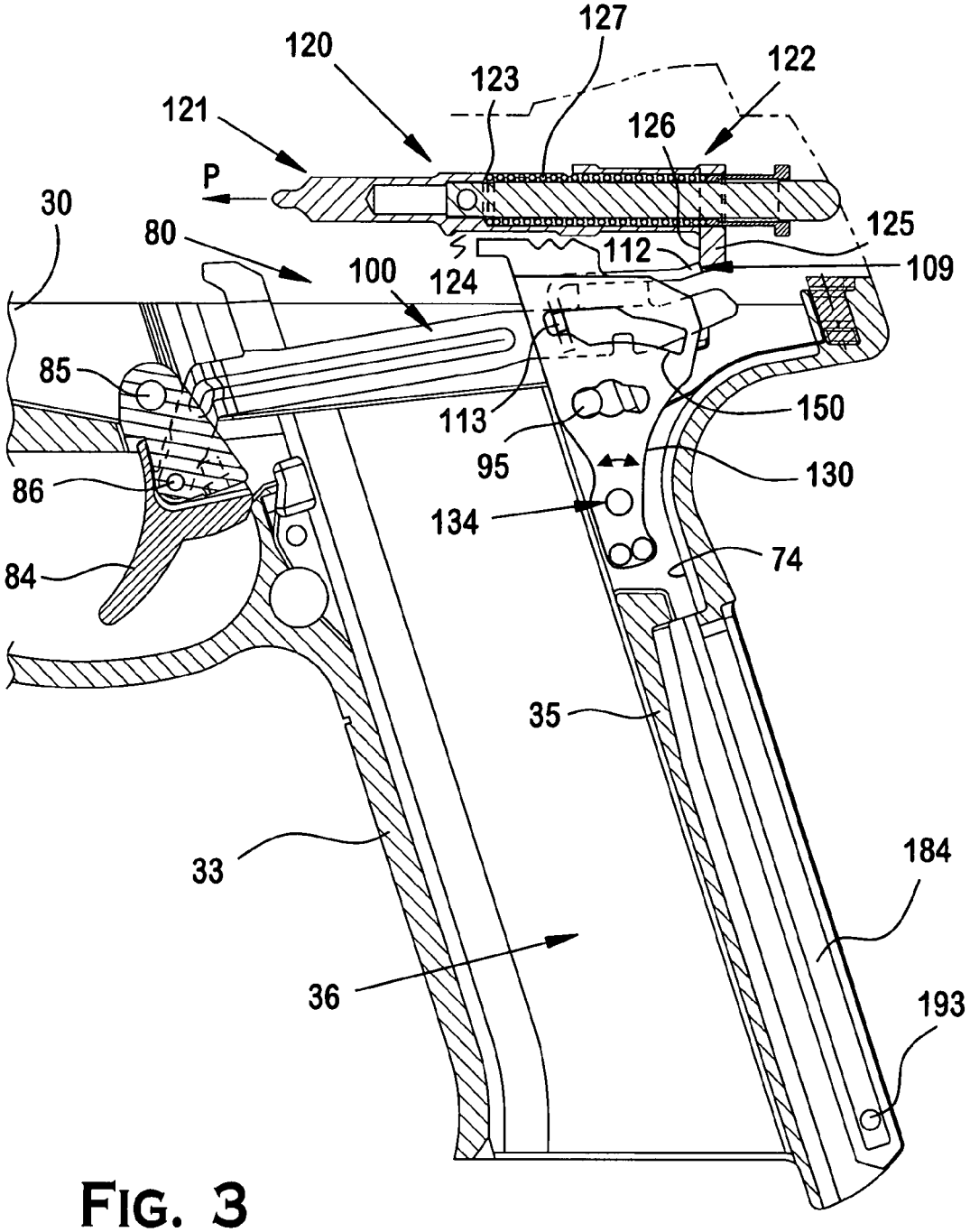
FIG. 3 is a partial cross sectional view of the pistol of FIG. 1 with the firing control mechanism activated and in the ready-to-fire position.
Figure 4:
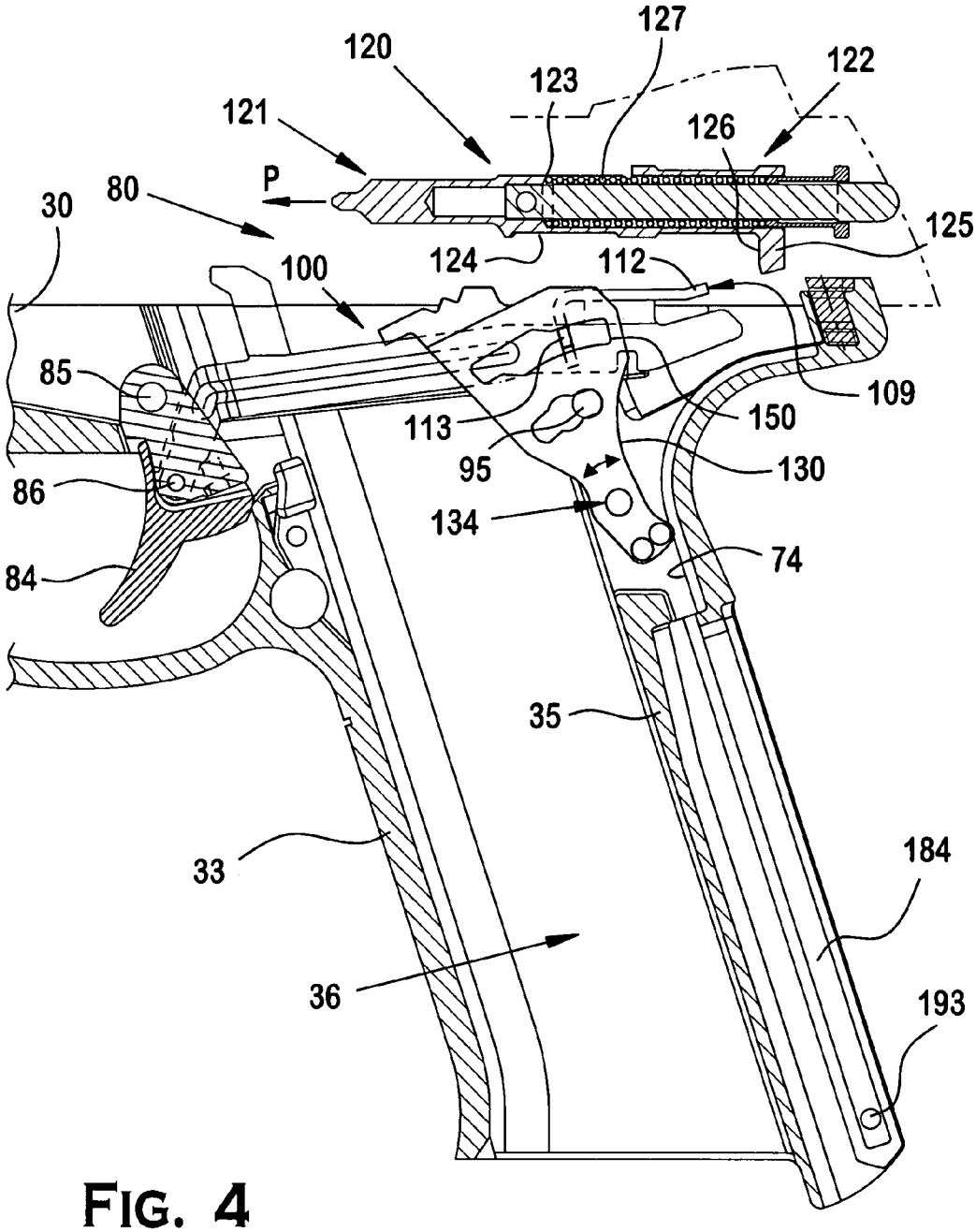
FIG. 4 is a partial cross sectional view of the pistol of FIG. 1 with the firing control mechanism deactivated and trigger in a forward position.
Figure 5:
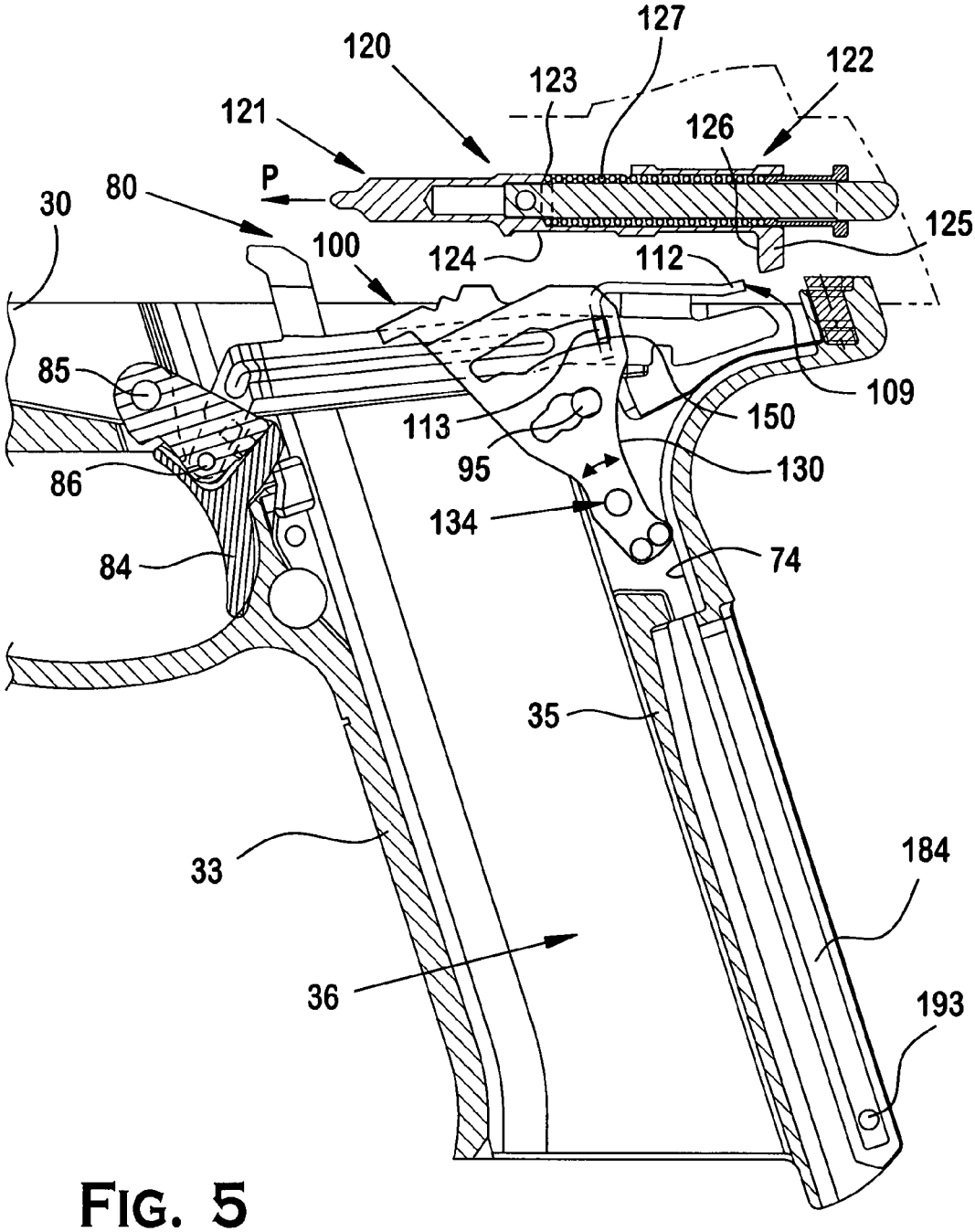
FIG. 5 is a partial cross sectional view of the pistol of FIG. 1 with the firing control mechanism deactivated and trigger in a rearward position.

FIGS. 3-5 shows a cross-sectional cutaway view of pistol frame 30 with firing control mechanism 80 positioned therein in various operating positions. Firing control mechanism 80 includes a trigger assembly including trigger 84 movably mounted to frame 30 and trigger bar 100 movably coupled to the trigger for movement responsive to movement of the trigger, an ejector 130 adapted to engage the trigger bar, and a spring-loaded striker or striker 120. In one embodiment, striker 120 is movably disposed in slide 60 for axial reciprocating movement rearwards and forwards towards chamber 42 to strike a chambered cartridge 50. Since striker 120 is carried by slide 60, the striker is axially movable in concert or unison with the slide in longitudinal rearward and forward directions on frame 30. Accordingly, striker 120 preferably is axially movable in a longitudinal path of travel "P" along the longitudinal axis LA with slide 60. Striker 120 also has a limited range of axial motion independent of and within slide 60 between a cocked and a released position to strike a chambered cartridge 50 while slide 60 remains stationary on the frame with breech area 72 closed during ignition of the cartridge.

In one embodiment, trigger 84 is pivotably mounted to frame 30 via a transversely mounted trigger pivot pin 85, which in one embodiment is located on an upper portion of the trigger. Trigger 84 and trigger bar 100 in turn are pivotably coupled together via a transversely-mounted trigger bar pivot pin 86 to allow pivotal movement of the trigger with respect to the trigger bar. In one embodiment, pivot pin 86 is located proximate a front portion 101 of trigger bar 100.

In the preferred embodiment, striker 120 is preferably a striker-type striker ("striker") and includes a top 123, bottom 124, a front portion 121 and a rear portion 122, as best shown in FIGS. 3-5. Striker 120 preferably includes a downward-extending operating protrusion 125 formed on or connected to bottom 124 of striker 120 for cocking, holding, and ultimately releasing striker 120 to discharge pistol 20. In one possible embodiment, protrusion 125 further defines front vertical surface 126 which may be engaged for operating striker 120 in the foregoing manner. Striker 120 is biased forward in a direction toward chamber 42 and cartridge 50 (when loaded in the chamber) by a striker spring 127. Accordingly, when the striker is forced rearwards in pistol 20 and assumes a cocked position, spring 127 is compressed so that release of the striker via a trigger pull urges the pin forward to strike chambered cartridge 50 and discharge the pistol.

As shown in further detail in FIGS. 6-8, trigger bar 100 may be a generally elongate structure including a top 110, bottom 111, front portion 101, opposite rear portion 103, and intermediate portion 102 disposed therebetween. Front portion 101 defines a hole 104 for receiving trigger bar pivot pin 86 for movably mounting the trigger bar to trigger 84. In one embodiment, a laterally-protruding flange 105 is formed or attached to rear portion 103 of trigger bar 100. Flange 105 includes a generally horizontal section 106, a downwardly-extending section 107 forward of and disposed at an angle to the horizontal section, and a rearwardly-extending section 108 extending rearward from the horizontal section. In one embodiment, section 107 defines a hole 114 for mounting a trigger bar tensioning spring 144 as further described herein.

With continuing reference to FIGS. 6-8, trigger bar 100 includes a striker catch 112 for cocking, holding, and releasing the striker in response to a trigger pull. In one embodiment, striker catch extends outwardly from trigger bar 100 and in one embodiment may be defined by a portion of flange 105 of trigger bar 100. In one possible embodiment as shown, striker catch 112 may be defined on section 108 of flange 105 and be slightly flared or angled upwards with respect to section 108. Catch 112 defines a rear vertical surface 109 for mutually engaging front vertical surface 126 of downwardly-extending protrusion 125 on striker 120 (see also FIGS. 3-5). The engagement of striker catch 112 and striker 120 will be further described herein.

With continuing reference to FIGS. 6-8, trigger bar 100 preferably further includes an operating portion such as operating lug 113 for use in manually raising and lowering trigger bar 100 to allow slide 60 to be removed from frame 30 such as for maintenance of pistol 20, to be further described herein. In one embodiment, operating lug 113 may be formed with or attached to downwardly extending section 107 of trigger bar 100 and may further extend laterally from trigger bar 100. However, it will be appreciated that in other embodiments operating lug 113 may be formed by or attached to other suitable portions of trigger bar 100 and may have other forms or shapes than shown in the figures.

Figure 12:
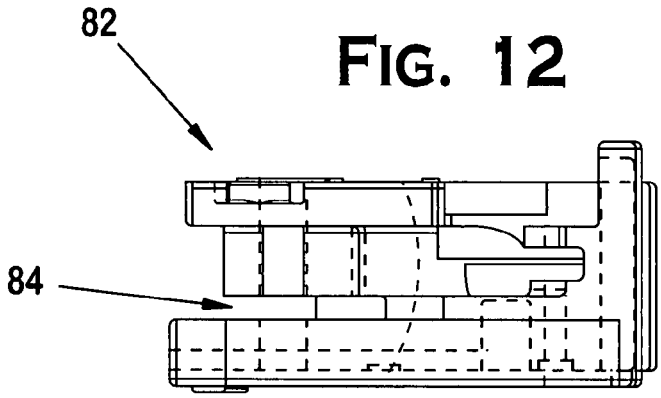
FIG. 12 is a top view of the firing control housing of FIG. 10.
Figure 11:
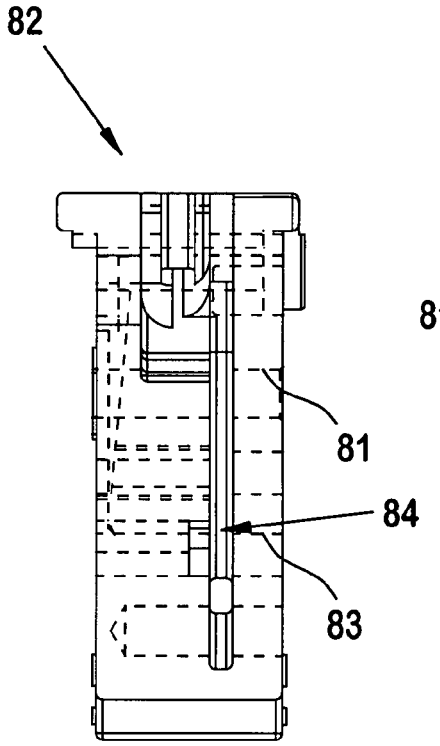
FIG. 11 is a front view of the firing control housing of FIG. 10.
Figure 10:
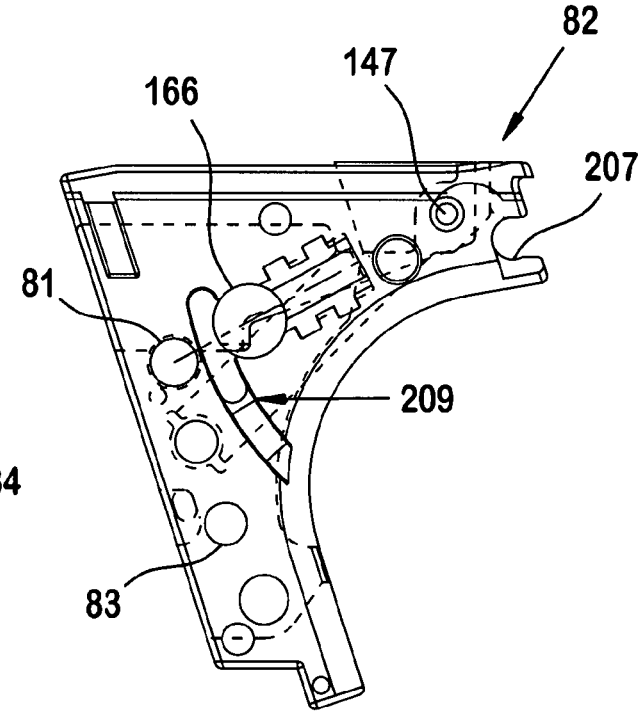
FIG. 10 is a side view of the firing control housing of the pistol of FIG. 1.
Figure 14:
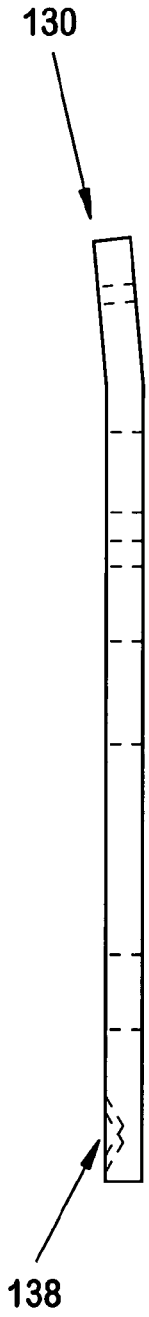
FIG. 14 is a front view of the ejector of FIG. 13.
Figure 13:
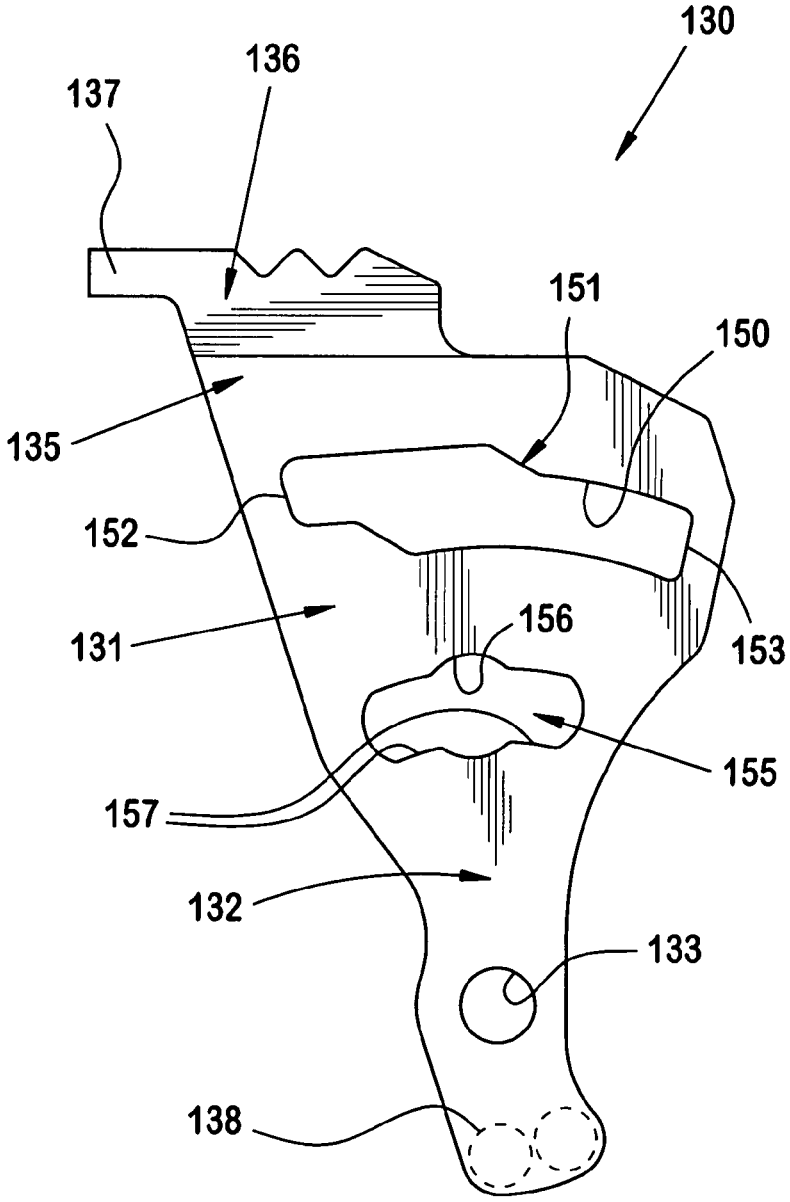
FIG. 13 is a side view of the ejector of the pistol of FIG. 1.

Referring generally to FIGS. 3-5, and specifically to FIGS. 10-12, a firing control housing 82 may be provided which at least partially houses and supports various components of firing control mechanism 80, and which further operably interacts with these components to provide various operating functions as described herein. The firing control housing allows a number of individual and sometimes small parts to be conveniently assembled together into a modular unit apart from the pistol, and then easily inserted into pistol frame 30 as a single unit instead of as a plurality of individual parts. Firing control housing 82 in one possible embodiment is preferably removably mounted in a cavity 74 provided in a rear portion of frame 30, and more preferably near grip frame 32. Firing control housing 82 is mounted to frame 30 in one embodiment via a transversely mounted pin such as cross-pin 95 (see FIGS. 15-17) which is received by frame 30 through apertures 81 in the housing (see FIG. 10).

Figure 19:
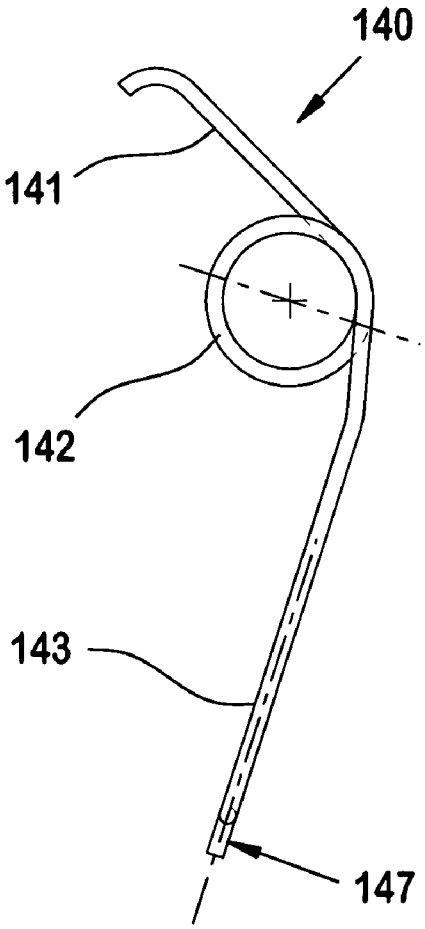
FIG. 19 is a side view of a trigger bar lift spring of the pistol of FIG. 1.
Figure 20:
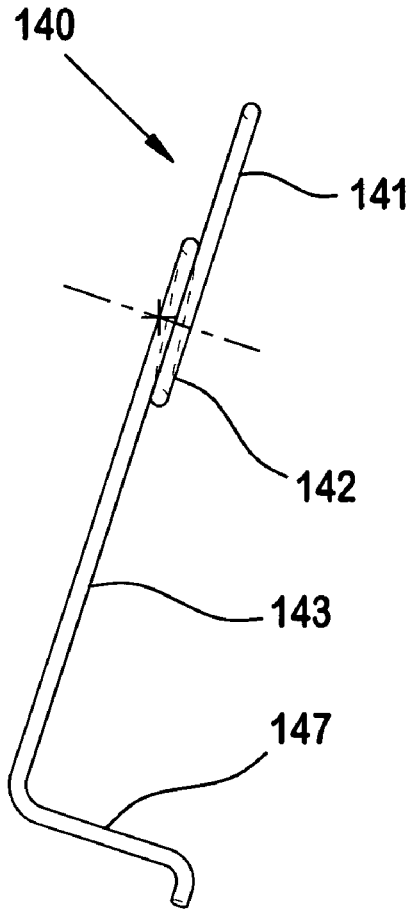
FIG. 20 is a front view of the trigger bar lift spring of FIG. 19.
Figure 26:
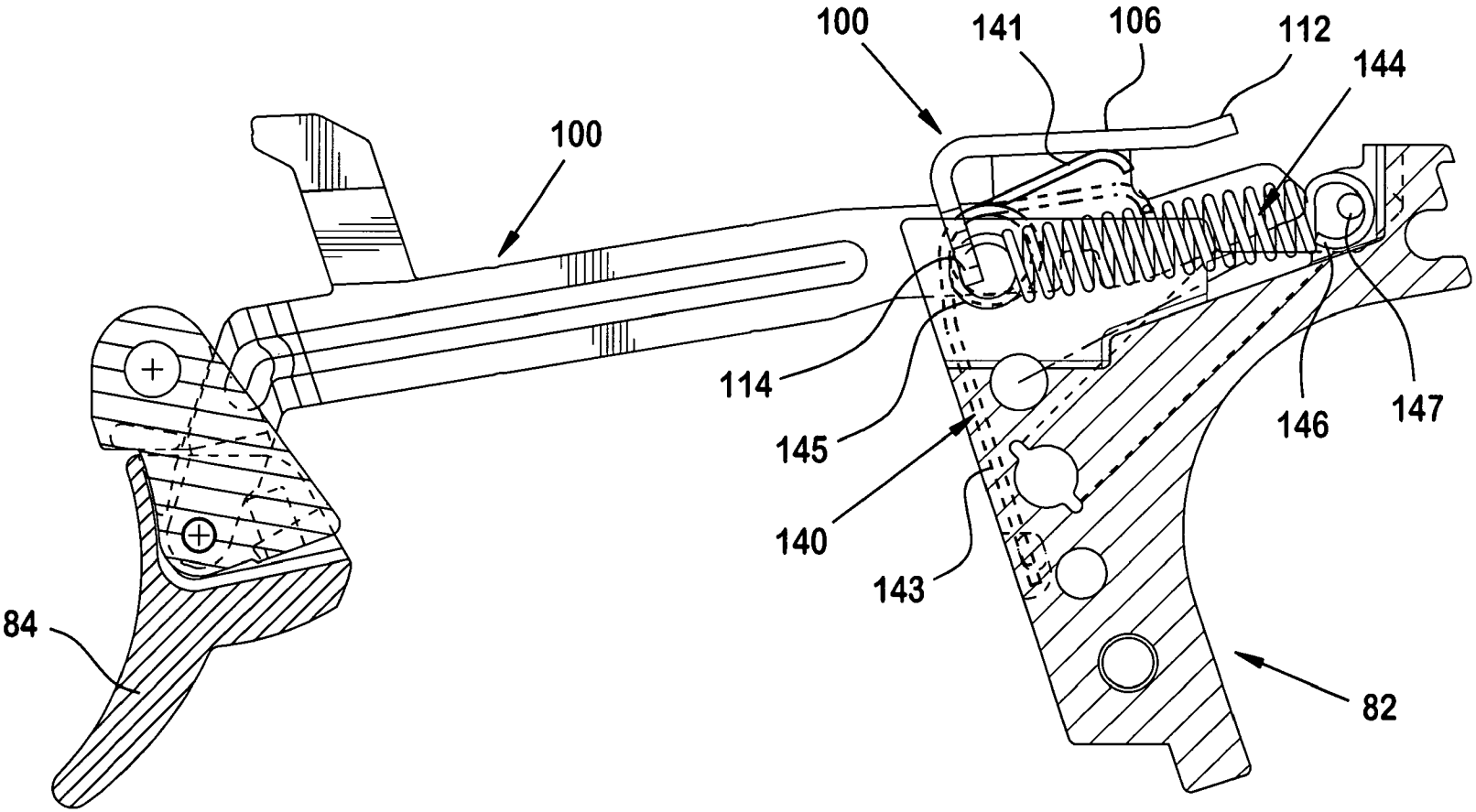
FIG. 26 is a side view of the trigger assembly and firing control housing of the pistol of FIG. 1 showing the trigger bar lift spring and tensioning spring.

In a preferred embodiment, trigger bar 100 is biased upwards towards engagement with striker 120 by a biasing member such as trigger bar lift spring 140 as shown in FIGS. 19 and 20. In one embodiment, lift spring 140 may be a torsion spring including a cylindrically-wound circular portion 142 and upper leg 141 and lower leg 143 each extending outwards from the circular portion. Lower leg 143 braces spring 140 against a surface in pistol 20 and may include a laterally-extending portion 147 disposed at an angle to the vertical portion shown. As shown in FIG. 26, upper leg 141 acts on and engages a bottom surface 115 on the underside of flange member 105 to transmit an upwards biasing force on rear portion 103 of trigger bar 100. Preferably, the biasing force places rear vertical surface 109 of striker catch 112 in the forward path of travel "P" along longitudinal axis LA of front vertical surface 126 of downwardly-extending striker protrusion 125 (see, e.g. FIG. 3). During normal operation of pistol 20, therefore, mutual engagement between striker catch 112 and downwardly-extending protrusion 125 of the striker allows the striker to be cocked and held in a ready-to-fire cocked position until released via a trigger pull.

Referring to FIG. 18, in a preferred embodiment, a second biasing member such as trigger bar tensioning spring 144 is provided that tensions and biases the trigger bar towards the rear of pistol 20. Preferably, trigger bar spring 144 also biases trigger bar 100 upwards to provide a backup for trigger bar lift spring 140. Trigger bar spring 144 may be a helical extension spring in one possible embodiment having a front end 145 engaged with hole 114 in flange member 105 of trigger bar 100 (see FIGS. 6 and 8) and an opposite rear end 146 engaged with a rear part of pistol 20 such as pin 147 transversely mounted in firing control housing 82 (see FIG. 10). Preferably, rear end 146 of spring 144 is mounted at least slightly higher than front end 145 so that trigger bar spring 144 biases trigger bar 100 not only rearwards, but slightly upwards as well. This upward lift force component of spring 144 advantageously provides a degree of redundancy for trigger bar lift spring 140 so that the firing mechanism of the pistol may still function even if main lift spring 140, which is primarily relied upon to bias the trigger bar upwards, were to break during usage until a new lift spring can be installed.

FIG. 26 shows both trigger bar lift spring 140 and tensioning spring 144 mounted in their respective positions in firing control housing 82.

According to one aspect of the preferred embodiment, a trigger bar camming member is provided for manually changing the position of the trigger bar to remove slide 60 from pistol 20. The camming member cams trigger bar 100 downward so that slide 60 with striker 120 can be slid forward past the striker catch 112 on the trigger bar, and subsequently removed from frame 30 when field stripping pistol 20 for maintenance. Otherwise, striker catch 112 on trigger bar 100 would ordinarily be in an upward position that blocks the forward path of travel "P" of striker protrusion 125 as described herein.

In a preferred embodiment, the trigger bar camming member advantageously may be ejector 130, which serves the dual functions of camming the trigger bar downwards for removing slide 60 from pistol 20 and expelling spent cartridge 50 casings from the pistol in a conventional manner after firing.

Referring now to FIGS. 3-5 and 13-14, ejector 130 in one embodiment may be a generally flat plate having a somewhat wedge-shaped main body 131 with a narrow lower portion 132 and a wider upper portion 135 to accommodate various appurtenances and apertures. Accordingly, ejector 130 has a width measured in the direction of longitudinal axis LA which is substantially greater than a thickness which is measured transversely to longitudinal axis LA, both measurements defined when the ejector is mounted in firearm 20. In one embodiment, ejector 130 is preferably mounted in firing control housing 82 in slot 84 (see FIGS. 10-12) which preferably is sized and configured to pivotably receive ejector 130 therein. Lower portion 132 of ejector 130 defines a circular hole 133 which aligns with hole 83 in firing control housing 82 to receive a transverse mounting pin 134 for pivotally mounting the ejector in the firing control housing. Accordingly, pin 134 defines a pivot point for ejector 130 which is pivotably moveable in forward and rearward directions as indicated by the directional arrows shown in FIGS. 3-5. In one embodiment, ejector is movable from a generally upright or vertical rearward position as shown in FIG. 3 to an angled forward or downward position as shown in FIGS. 4 and 5.

An upper portion 135 of ejector 130 includes a control arm 136 that projects upwards therefrom, and in one embodiment may include an elongated forward-extending portion 137. Control arm 136 provides an actuator for a pistol user to manually alter the position of ejector 130, in addition to engaging and ejecting spent cartridge 50 casings from the pistol. A pair of detents 138 may be provided near the bottom of ejector 130 below pivot point "P" that alternatingly engage a spring-loaded plunger (not shown) in firing control housing 82 to help retain the ejector in at least two positions; one being a generally upright or vertical rearward position as shown in FIG. 3 and the other being an angled forward or downward position as shown in FIGS. 4 and 5.

With continuing reference to FIGS. 3-5 and 13-14, ejector 130 further includes a camming surface 151 that operably engages operating lug 113 of trigger bar 100 to allow a user to manually alter the position of the trigger bar. In one embodiment, camming surface 151 is preferably defined by an elongate trigger bar control slot 150 in ejector 130, and more preferably by an upper portion of slot 150 since trigger bar 100 is biased upwards by springs 140 and 144 so that lug 113 would ordinarily contact the upper portion of the slot. Slot 150 further servers to vertically restrain and retain trigger bar 100 in pistol 20 and firing control housing 82 via interaction between the upper portion of the slot and trigger bar lug 113. In one embodiment, slot 150 preferably has a generally arcuate shape to accommodate the pivotal movement of ejector 130 and interaction with lug 113 in the slot. Slot 150 includes a front 152 and a rear 153 that defines a range of possible movement for lug 113 in the slot (and concomitantly trigger bar 100). A forward portion of slot 150 proximate the front 152 preferably is cooperatively sized with lug 113 to have a vertical height close to the height of the lug to minimize vertical play in the slot. When lug 113 is located in this forward portion of slot 150 when the trigger bar 100 is in the ready-to-fire position, only limited vertical movement range is permitted so that if the pistol were dropped without a trigger pull, the trigger bar could not move vertically enough as required to release striker 120 and discharge the pistol. An intermediate portion of slot 150 preferably has a greater height than the forward portion to allow sufficient vertical movement of trigger bar 100 when trigger 84 is pulled to fully cock and release striker 120 to discharge the pistol.

It should be noted that although ejector 130 may advantageously serve as the trigger bar camming member in the preferred embodiment to reduce the number of components required and thereby maintain a compact and light-weight pistol design, in other embodiments contemplated a separate trigger bar camming member may be furnished. Accordingly, the invention is not limited in that regard.

Operation of ejector 130 and removal of slide 60 when field stripping pistol 20 will now be described. In a preferred embodiment, pistol 20 may be a type of automatic pistol design in which slide 60 is moved forward to remove the slide from frame 30. Accordingly, pistol frame rails 62 and slide channels 61 (see FIG. 2) preferably are configured such that the slide is moved forward to a dismounting point on frame 30 where the rails may be disengaged from the channels, thereby allowing the slide to be removed from pistol 20.

Referring to FIG. 3, pistol 20 and firing control mechanism 80 are shown in the ready-to-fire position. Trigger bar 100 is in a first vertical or upward position in which striker catch 112 on trigger bar 100 preferably is axially aligned with and blocks the forward path of travel "P" along longitudinal axis LA of downward protrusion 125 on striker 120. Accordingly, the position of trigger bar 100 shown in FIG. 3 may be considered a blocking position because slide 60, with striker 120 disposed therein and movable in concert with the striker, cannot be moved forward on frame 30 past the point where trigger bar catch 112 and striker protrusion 125 are engaged. Striker catch 112 is shown engaged with downwardly-extending protrusion 125 of striker 120 to hold the striker in a half-cocked position. If pistol 20 is to be discharged, pulling on trigger 84 would cause trigger bar 100 in response to move rearwards and then downwards with respect to frame 30 to fully cock and then release striker 120 to strike a chambered cartridge 50. Ejector 130 is in a generally upright or vertical rearward position as shown in FIG. 3 in which lug 113 of trigger bar 100 is located proximate to front 152 of trigger bar control slot 150.

If pistol 20 is to be dismantled for inspection and maintenance, the user moves slide 60 rearward on frame 30 to open the action (i.e., breech area 72 with breech face on front of slide 60 spaced apart rearwards from chamber 42). The user engages slide stop 170 movably mounted on frame 30 with slide cutout 171 disposed in the slide (see FIG. 1A) to hold slide 60 with striker 120 disposed therein in a rearward position with the action open. Alternatively, if pistol 20 has been discharged and the last cartridge 50 in the magazine 70 has been used, the action will automatically remain open. The user may now visually inspect the action to verify that a cartridge is not loaded in chamber 42. If magazine 70 has not already been removed, the magazine is withdrawn from magazine grip adaptor cavity 36 of grip frame 32.

With the action now open in pistol 20, the user may reach down into the open action and manually pivot or fold ejector 130 forwards and downwards by pressing down on ejector control arm 136 with a finger. Ejector 130 at least partially enters now empty magazine cavity 36 and reaches the angled forward or downward position shown in FIGS. 4 and 5. In folding ejector 130 forward, trigger bar 100 is concomitantly cammed downwards by interaction between lug 113 on the trigger bar with camming surface 151 of slot 150 in ejector 130 in the manner described herein. This moves trigger bar 100 in spatial relationship with respect to frame 30 and striker 120 from the first blocking position described above to a second position. In this second downward position of trigger bar 100, which preferably is lower than its first position, striker catch 112 on trigger bar 100 no longer is aligned with or blocks the forward path of travel "P" along longitudinal axis LA of downward protrusion 125 on the striker 120. Accordingly, the position of trigger bar 100 shown in FIGS. 4 and 5 may be considered an nonblocking position. Lug 113 is now located in a more rearward location in slot 150 closer to rear 153, as shown in FIGS. 4 and 5. Slide 60, with striker 120 disposed therein and movable in concert with the slide, may then be slid forward on frame 30 with striker protrusion 125 clearing striker catch 112 to the dismounting point where frame rails 62 and slide recesses 61 may be disengaged and the slide removed from the pistol. It should be noted that FIG. 5 is similar to FIG. 4, but shows the ejector folded downwards after a trigger pull with trigger 84 remaining in a rearward pulled position such as would occur when the last cartridge in the magazine has been used and the action remains open, as described above.

To reinstall slide 60 on frame 30, the slide channels 61 are re-engaged with rails 62 and slide 60 is slid back on the frame until at least striker protrusion 125 is rearward of trigger bar striker catch 112. Ejector 130 may then be manually lifted up and pivoted rearward to place firing control mechanism 80 back in the ready-to-fire position shown in FIG. 3. Once again, trigger bar 100 with striker catch 112 is again in the blocking position wherein the forward path of travel "P" of striker protrusion 125 along the longitudinal axis LA is once again blocked by the striker catch. Trigger bar 100 is now operative to hold, cock, and release the striker via a trigger pull for discharging pistol 20.

According to another aspect of the preferred embodiment, ejector 130 further provides an interlock system for preventing the firing control housing mounting pin 95 from coming loose or being accidentally removed by the user during active operation of pistol 20. Since mounting pin 95 in one embodiment is externally accessible to the user from the side of pistol 20 (see, e.g., FIG. 1), the interlock system is intended to preclude disassembly of the firing control mechanism while the magazine is in place without proper disassembly procedures being followed.

Referring to FIGS. 13 and 15-17, a pistol 20 with a firing control housing mounting pin interlock system includes an ejector 130 having a mounting pin slot 155, which in a preferred embodiment may be slightly arcuate in shape. Slot 155 is sized and configured for receiving and interacting with firing control housing mounting pin 95 (see FIGS. 15-17). Slot 155 preferably has an enlarged generally circular central portion 156 and vertically narrower front/rear portions 157.

With continuing reference to FIGS. 13 and 15-17, mounting pin 95 includes a shaft 98 and head 99. Shaft 98 has a first diameter $D1_{mp}$ defined across cylindrical portion the shaft. Shaft 98 further preferably includes a pair of diametrically opposed flats 96*a* disposed on opposite sides of the pin shaft 98 as shown defining a second shaft reduced diameter $D2_{mp}$ measured from flat-to-flat that preferably is smaller than shaft diameter $D1_{mp}$. This defines a pair of opposed shoulders 96*b* on either side of each flat as shown. In one embodiment, head 99 of mounting pin 95 preferably includes a flat side portion 97 in one embodiment that mates with a complementary-configured a hole 75 in pistol grip frame 34 (see FIG. 1A) that also includes a flat portion. This prevents mounting pin 95 from rotating with respect to ejector 130 and grip frame 34 to keep the mounting pin vertically oriented as shown in side view FIG. 16. Therefore, when firing control housing mounting pin 95 is inserted through slot 155, flats 96*a* remain properly oriented and aligned with the upper and lower portions of slot 155 so that one flat each is positioned approximately vertically on the top and bottom of the pin.

With continuing reference to FIGS. 13 and 15-17, the narrow portions 157 of ejector slot 155 are sized and configured with the mounting pin shaft flats 96*a* so that the ejector 130 may be pivoted or rotated with the mounting pin riding in the slot narrow portions. Mounting pin 95, however, preferably cannot be laterally removed through ejector slot 155 when positioned in either of the narrow slot portions 157 of the slot due to interference between ejector 130 and shoulders 96*b* of the mounting pin. For example, FIG. 3 shows mounting pin 95 positioned in the narrow front portion 157 of slot 155 when the firing control mechanism is in the ready-to-fire position.

In FIGS. 4 and 5, mounting pin 95 is positioned in the narrow rear portion 157 of slot 155 when ejector 130 is folded forward (either with or without the trigger remaining in a pulled rearward position, respectively). Mounting pin 95 cannot be normally removed from pistol 20 when positioned as shown in FIGS. 3-5.

With continuing reference to FIGS. 13 and 15-17, to remove firing control housing 82 from pistol 20, mounting pin 95 must first positioned in and concentrically aligned with central opening 156 by placing ejector 130 in an intermediate position between those shown in FIGS. 3 and 4. Because enlarged central portion 156 of ejector slot 155 is preferably sized larger than the main diameter $D1_{mp}$ of mounting pin shaft 98 on either side of flats 96, mounting pin 95 may now be driven out from pistol 20 through ejector 130 to release and remove firing control housing 82. It should be note that since in the preferred embodiment ejector 130 cannot be folded forward when the magazine is still in the pistol, pin 95 thus cannot be aligned with enlarged central portion 156 of slot 155 unless magazine 70 has first been properly removed when dismantling the pistol. In addition, the action of the pistol (i.e. breech area 72) must be open in the first instance to access and manually move ejector 130 to the intermediate position, thereby exposing chamber 42 so that the prudent user can also visually determine if a cartridge is present in the chamber. Therefore, the foregoing mounting pin interlock system contributes to the use of proper field stripping procedures to disassemble pistol 20.

Figure 9:
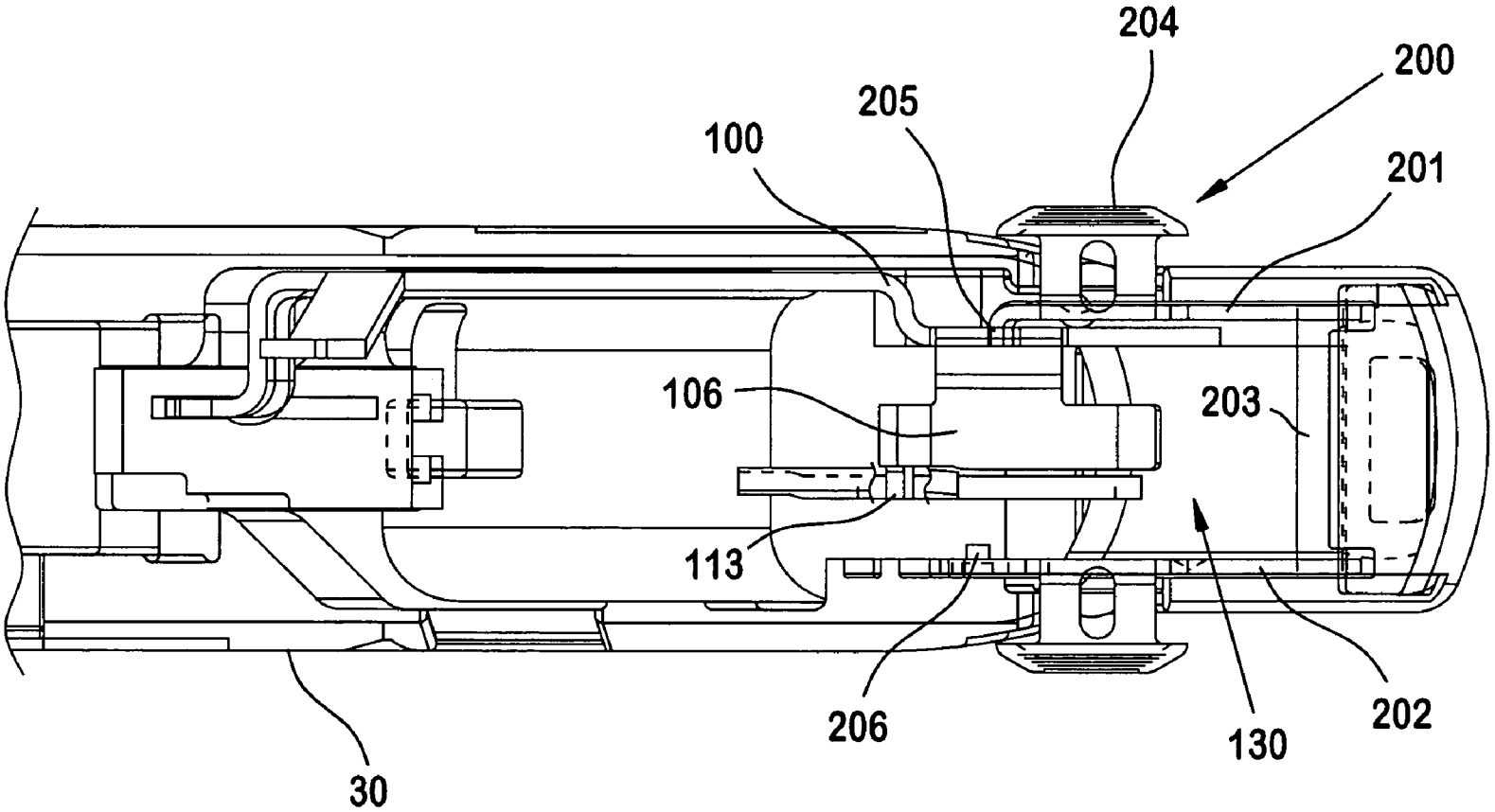
FIG. 9 is a partial top view of the pistol of FIG. 1 with the slide removed.
Figure 21:
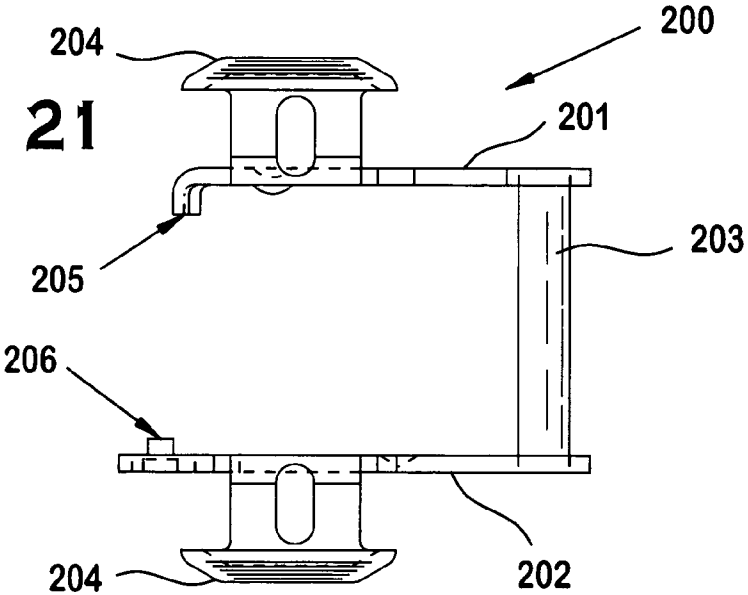
FIG. 21 is a top view of a manual safety of the pistol of FIG. 1.
Figure 23:
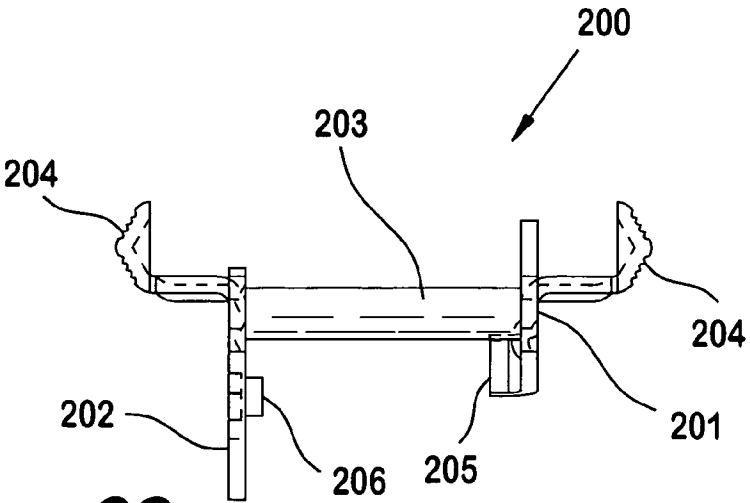
FIG. 23 is a rear view of the manual safety of FIG. 21.
Figure 22:
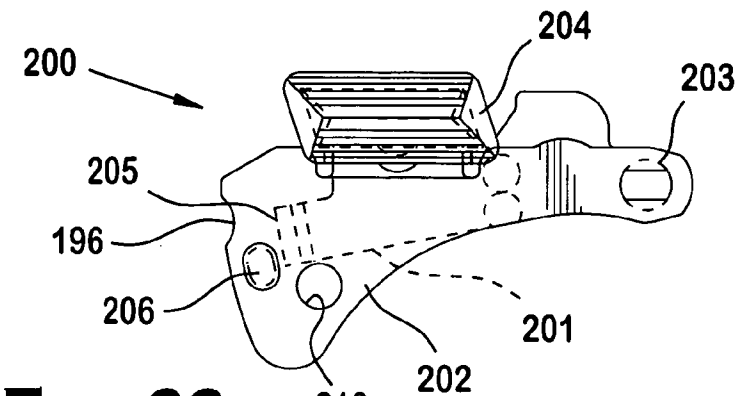
FIG. 22 is a side view of the manual safety of FIG. 21.

According to another aspect of the preferred embodiment, a lockable manual safety is provided to disable the firing control mechanism 80 of pistol 20. Referring to FIGS. 21-23, an ambidextrous safety 200 is provided in one embodiment that includes a pair of spaced-apart levers 201, 202 connected together by a coupling member such as cross-bar 203 for pivotably mounting the safety. With additional reference to FIGS. 9 and 10, cross-bar 203 is rotatably received in a complementary-sized recess 207 on the rear of firing control housing 82. Cross-bar 203 preferably is vertically rotatable in a preferred embodiment. Cross-bar 203 allows both levers 201, 202 to move together when the user operates either lever 201 or 202. Each lever 201, 202 preferably further includes a thumb-piece 204 that allows a pistol user to operate safety 200 from either side of the pistol.

With continuing reference to FIGS. 21-23, in one possible embodiment, lever 201 includes a projection such as laterally-projecting engaging tab 205 that engages a complementary-configured receptacle such as slot 208 in the bottom of trigger bar 100 (see FIGS. 6 & 7 and 34-35) for disabling the firing control mechanism 80 by arresting movement of the trigger bar. The engagement of tab 205 with slot 208 creates surface-to-surface contact between lever 201 of safety 200 and trigger bar 100. In one embodiment, tab 205 may project inwards from lever 201 and may be located on a forward portion of the lever. In other embodiments, tab 205 may have other suitable configurations, project from lever 201 in other directions, and be located on any other suitable portion of lever 201 so long as the tab can engage and arrest movement of trigger bar 100.

FIGS. 24-25, 34, and 35 show safety 200 in two possible operating positions. Referring to these figures, safety 200 in a preferred embodiment is selectively and pivotably movable by a user from a downward deactivated ("safety off") first position in which tab 205 is disengaged from trigger bar slot 208 to allow movement of the trigger bar (see FIGS. 24A, 24B and particularly 34), to a second upward activated ("safety on") position in which tab 205 is engaged with slot 208 (see FIGS. 25A, 25B and particularly 35) to arrest movement of the trigger bar so striker 120 cannot be released to discharge pistol 20, thereby disabling the firing control mechanism 82.

In a preferred embodiment, safety 200 may further be manually locked in the activated "safety on" position via a manual key-operated internal locking system that may be provided as shown in FIGS. 24-25. With continued reference first to FIGS. 21-23, the locking system includes lever 202 in one embodiment preferably further including an inwardly-projecting locking protrusion 206. Protrusion 206 is slidably received in an elongate and preferably arcuately-shaped slot 209, which in one embodiment may be disposed in and defined by grip frame 32. In a preferred embodiment, slot 209 may be formed in firing control housing 82 positioned in grip frame 32 (see FIG. 10). Preferably, protrusion 206 may be oval or round in cross-sectional shape to facilitate smooth movement in slot 209. Protrusion 206 travels generally vertically upwards and downwards in slot 209 between alternating positions as the safety 200 is selectively raised or lowered by the user to activate or deactivate the safety as further described herein. When safety 200 is mounted to firing control housing 82, levers 201, 202 of the safety are located and travel adjacent to the outside of firing control housing 82. Therefore, locking protrusion 206 in one possible embodiment is inserted into and through arcuately-shaped slot 209 from the outside. In other embodiments (not shown), locking protrusion 206 may be inserted into slot 209 from the inside firing control housing 82.

Figure 27A:
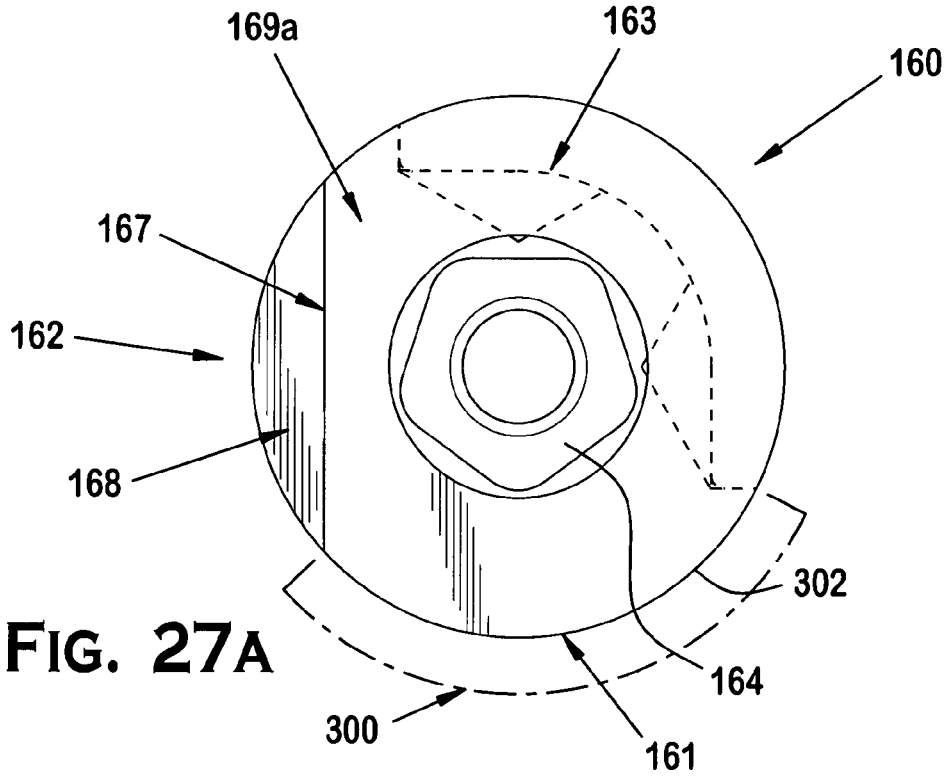
FIG. 27A is a side view of a lock pin of the pistol of FIG. 1.
Figure 27B:
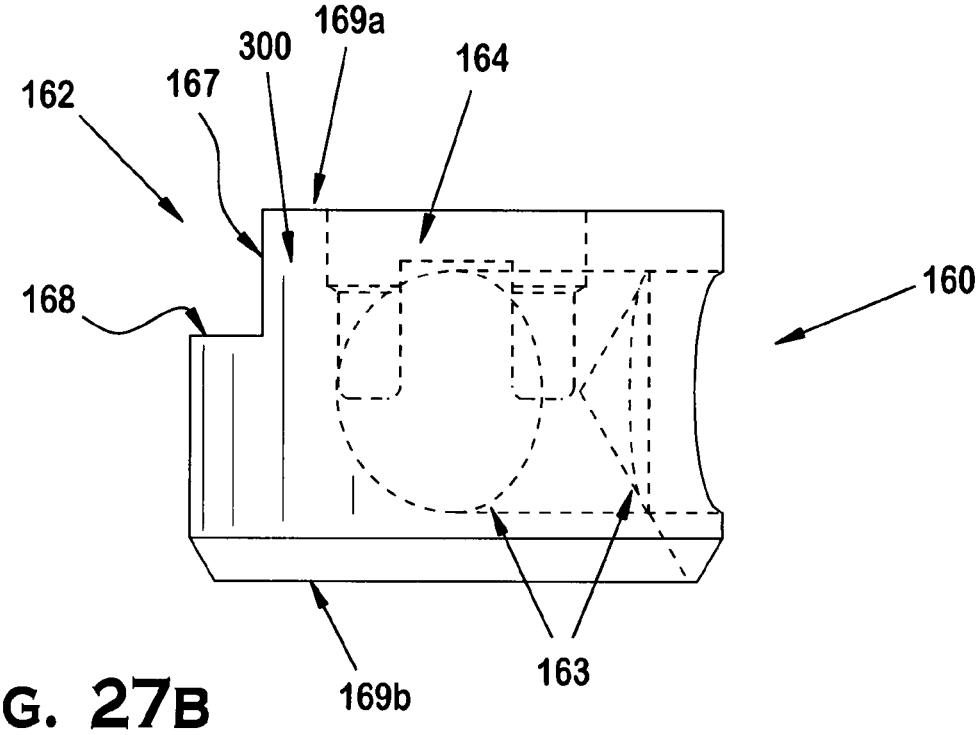
FIG. 27B is a bottom view of a lock pin of the pistol of FIG. 1

Locking protrusion 206 of safety 200 is operably associated with a locking member such as rotary lock pin 160 shown in FIGS. 27A and 27B. In one embodiment, lock pin 160 preferably is rotatably-received in a complementary-shaped recess 166 formed in firing control housing 82 (see, e.g., FIGS. 10 and 24A). In one possible embodiment, lock pin 160 includes a cylindrical body 161 having at least two detents 163. Detents 163 function with a complementary-shaped spring-loaded plunger 165 (see, e.g. FIGS. 24B and 25B) disposed in firing control housing 82 to help retain lock pin 160 in at least two rotational operating positions.

Lock pin 160 preferably further includes a stepped portion 162 (best shown in FIGS. 27A&B), which in a preferred embodiment functionally interacts with safety locking protrusion 206 of safety 200 and slot 209 in firing control housing 82 to lock safety 200 in the activated or "safety on" position. In one possible embodiment, stepped portion 162 is disposed in top surface 169*a* of lock pin 160, and extends at least partially across top surface 169 to occupy at least a portion of the outer circumference of the lock pin as shown in FIGS. 27A and 27B. Stepped portion 162 may be formed by two intersecting perpendicular flat surfaces such as bypass surface 167 and adjoining surface 168 that are formed or machined into the side 302 of lock pin 160. As further described below, bypass surface 167 defines a rotationally-movable surface that in one operating position aligns with slot 209 of firing control housing 82 to allow locking protrusion 206 of safety 200 to travel up and down past lock pin 160 in the slot.

It will be appreciated that in other embodiments contemplated, lock pin 160 may be provided without a stepped portion 162 such that bypass surface 167 may extend completely from the top surface 169 down to bottom surface 169*b* (shown in FIG. 27B) of the lock pin. Accordingly, lock pin 160 may have an entire side that is substantially flat to define bypass surface 167 (not shown).

With continuing reference to FIGS. 27A&B, of lock pin 160 further includes a rotatable arcuately-shaped blocking surface 300. Blocking surface 300 may be defined on a portion of the outer circumference of lock pin 160 in side 302. In one embodiment as shown, blocking surface 300 may be formed by a lower quadrant of lock pin 160 extending circumferentially on side 302 from a point approximately adjacent to bypass surface 167 to a point approximately adjacent to detent 163. Blocking surface 300 is operable to be projected into or to be retracted from slot 209 in firing control housing 82 by rotating lock pin 160. Accordingly, in the projected position, blocking surface 300 at least partially blocks slot 209 to interfere with the movement of and engage locking protrusion 206 of safety 200, thereby preventing movement of the locking protrusion past lock pin 160 in the slot.

Figure 24A:
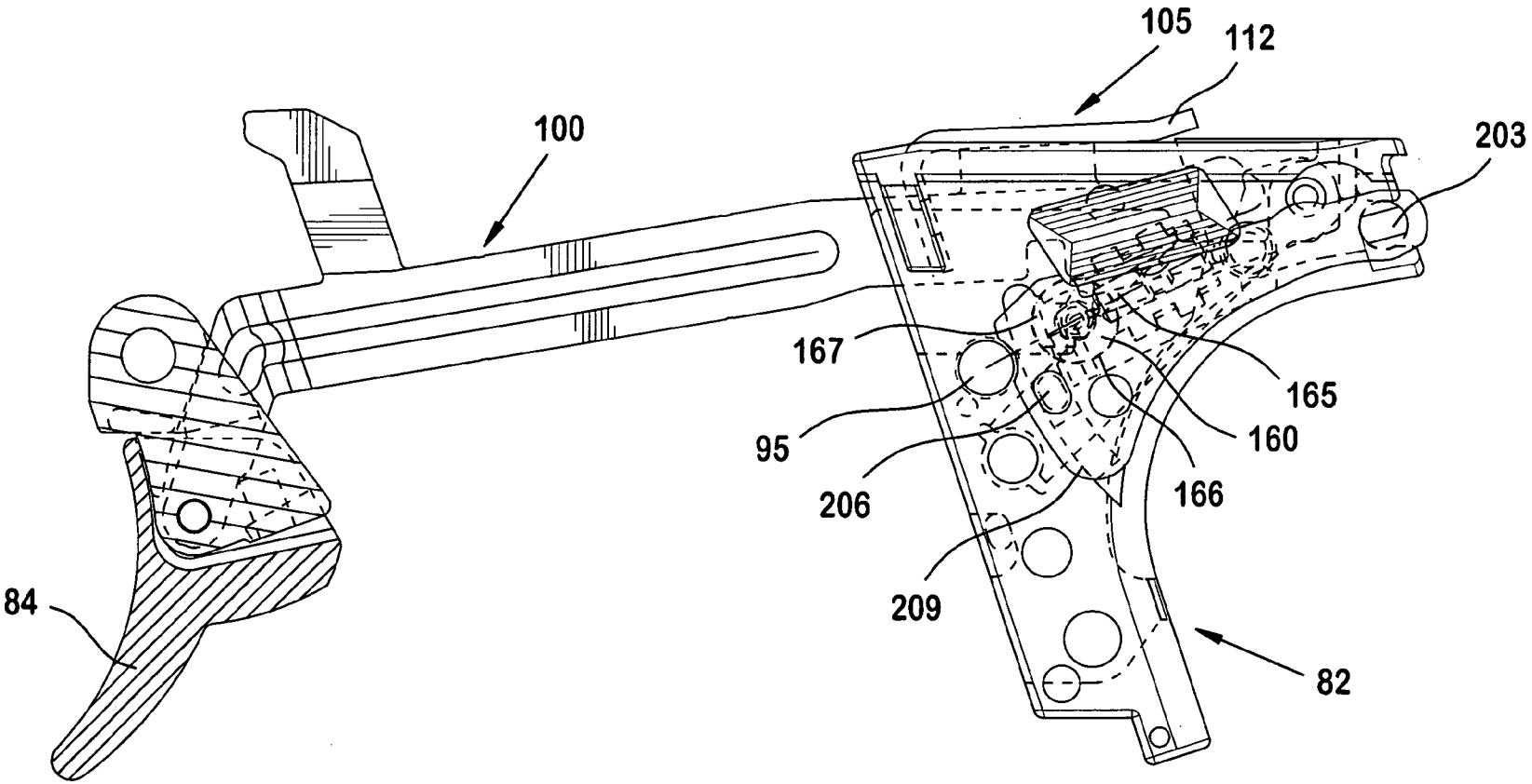
FIG. 24A shows the safety of FIG. 21 in an deactivated position.

Lock pin 160 is moveable between a first blocking "locked" position in which blocking surface 300 of stepped portion 162 at least partially occludes or blocks arcuately-shaped slot 209 (see FIG. 25A) and a second nonblocking "unlocked" position in which slot 209 is not blocked by lock pin surface 300 (see FIG. 24A). Preferably, detents 163 of lock pin 160 are radially positioned about 90 degrees apart in one embodiment so that a quarter turn of lock pin 160 by a user concomitantly rotates the lock pin by 90 degrees between the "locked" and "unlocked" positions.

Lock pin 160 further preferably includes a key engagement aperture 164 which is configured to operably receive a complementary-shaped key (not shown) used to operate the manual safety locking system. Accordingly, the key may be used to move lock pin 160 between the lock on and lock off positions. Key engagement aperture 164 may have any suitable configuration so long as it mates with whatever shaped key is used.

Figure 24B:
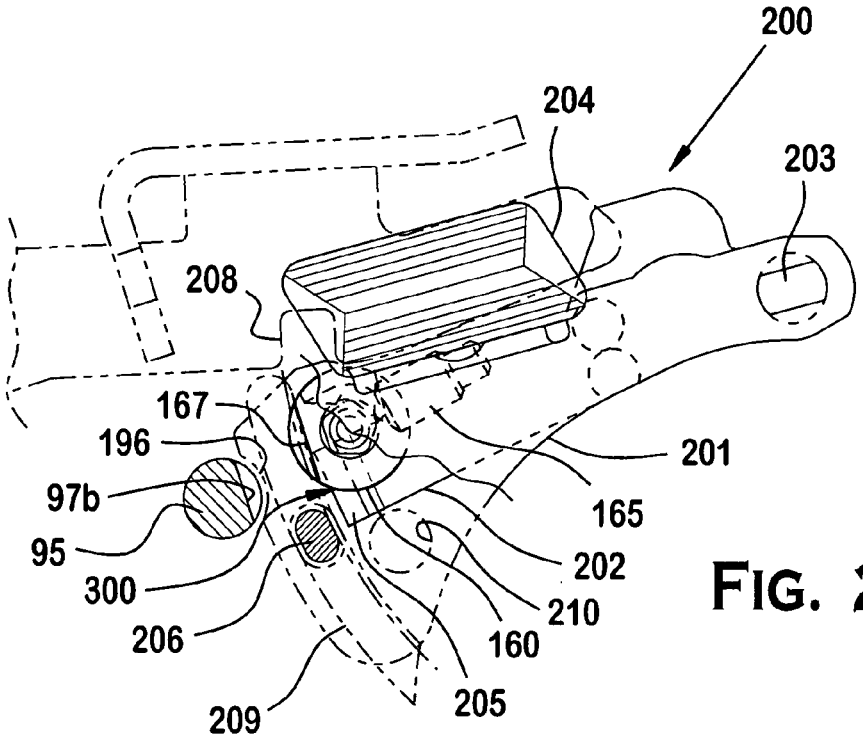
FIG. 24B is a close-up view of the safety as shown in FIG. 24A.
Figure 25B:
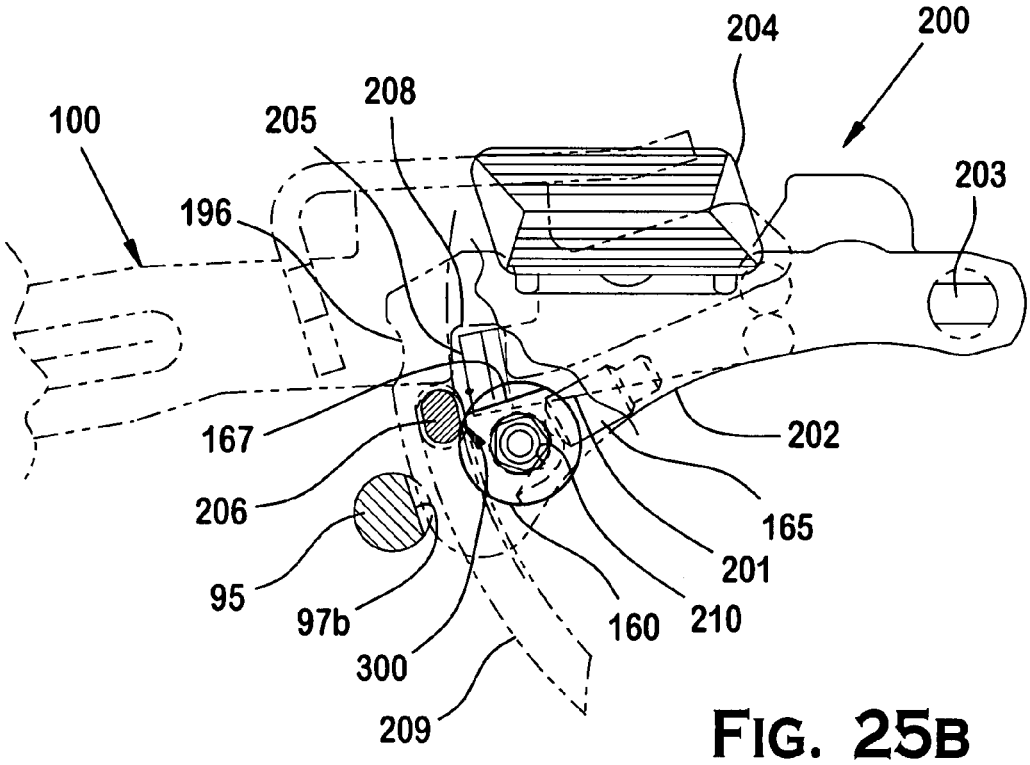
FIG. 25B is a close-up view of the safety as shown in FIG. 25A.
Figure 25A:
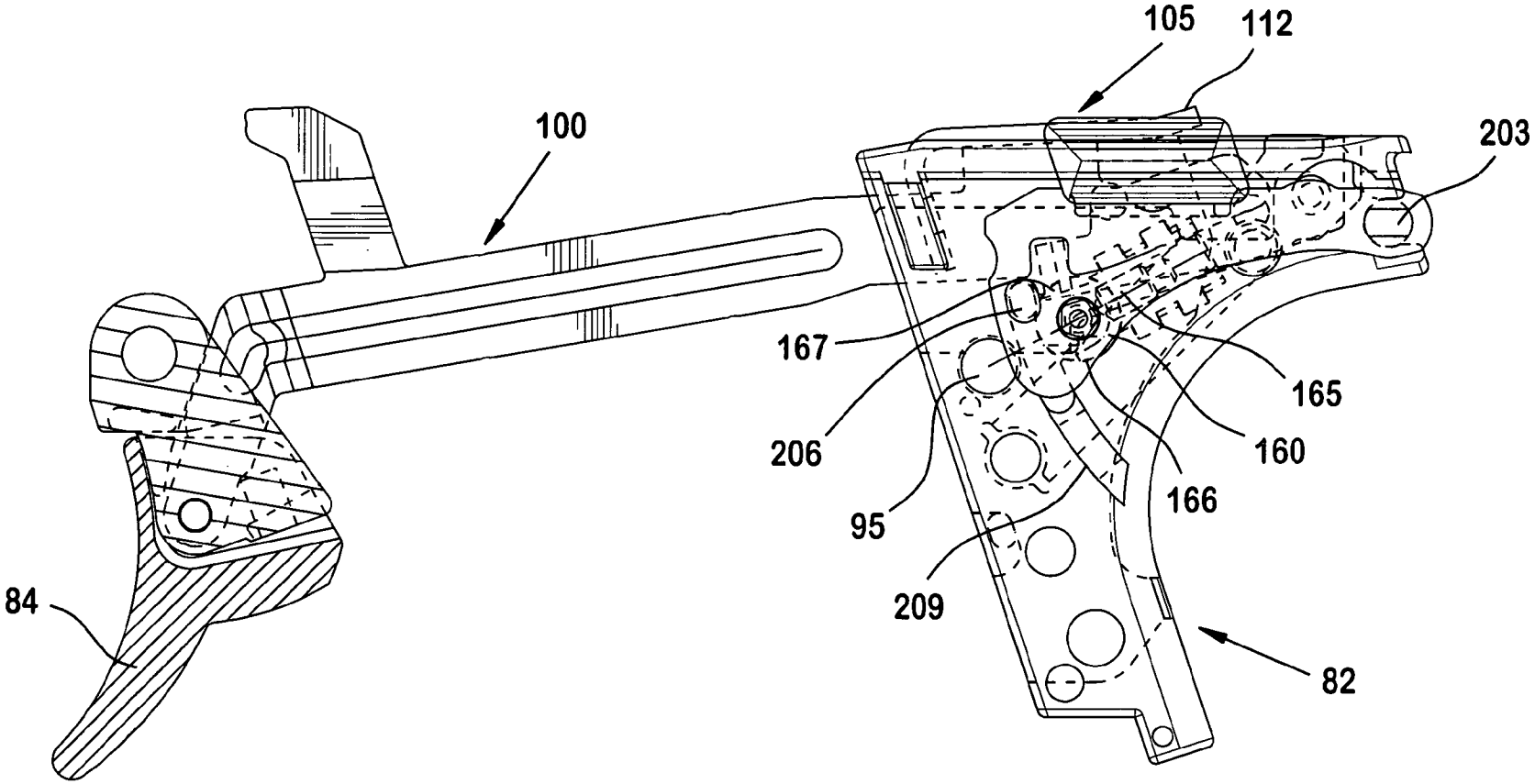
FIG. 25A shows the safety of FIG. 21 in an activated position.

Operation of safety 200 and internal locking system will now be described with additional reference to FIGS. 24A&B and 25A&B. FIGS. 24A and 25A show safety 200, trigger assembly, and firing control housing 82 disembodied from the pistol for clarity. FIGS. 24B and 25B show safety 200 disembodied from firing control housing 82.

Beginning with reference to FIGS. 24A&B, safety 200 is shown in the downward deactivated "safety off" position. Tab 205 on lever 201 is aligned with, but positioned below and disengaged from slot 208 in trigger bar 100 so that the trigger bar is free to move in response to a trigger pull to discharge pistol 20. Locking protrusion 206 is positioned in a lower part of arcuately-shaped slot 209 (preferably entering the slot from the outside as described above) and located generally below lock pin 160. Lock pin 160 is in the nonblocking "unlocked" position such that locking protrusion 206 is free to move up and down in arcuately-shaped slot 209. In this position, stepped portion 162 of lock pin 160 is positioned so that bypass surface 167 of the stepped portion is placed along side of and aligns with slot 209 allowing locking protrusion 206 to freely move past the lock pin. Blocking surface 300 as shown is retracted from slot 209 and does not interfere with the movement of locking protrusion 206 in the slot.

To activate manual safety 200, the pistol user moves the safety upwards to the generally horizontal "safety on" activated position by using one of the thumbpieces 204 located on either side of the safety. Tab 205 on lever 201 moves vertically upwards into engagement with slot 208 in trigger bar 100 to prevent rearward movement of the trigger bar sufficient to fully cock and release striker 120 via a trigger pull to discharge pistol 20 (see, e.g. FIG. 25A). Accordingly, the firing control mechanism 80 is thus disabled.

When safety 200 is moved to the activated "safety on" position, locking protrusion 206 of safety 200 concomitantly moves simultaneously from the lower part of arcuately-shaped slot 209 (shown in FIGS. 24 A and B) to become positioned in an upper part of arcuately-shaped slot 209 as shown in FIGS. 25A and B. Preferably, protrusion 206 is also positioned slightly above lock pin 160.

To lock pistol 20 with safety 200 in the "safety on" position which disables the firing control mechanism 80, a specially-configured key (not shown) is inserted into and engaged with lock pin key engagement aperture 164. The user then rotates lock pin 160 with the key to the "locked" position, preferably a quarter turn (90 degrees) in one possible embodiment, to project at least a portion of blocking surface 300 into slot 209 of firing control housing 82 sufficient to at least partially obscure or block slot 209. Locking protrusion 206 of safety 200 cannot be move past lock pin 160 in slot 209. Accordingly, locking protrusion 206 is trapped in the upper portion of arcuate slot 209 above blocking surface 300 and safety 200 cannot be moved downwards past lock pin 160 away from the "safety on" position without use of the key.

Preferably, in one embodiment, safety 200 is further configured to prevent a user from locking the firing control mechanism 80 in an active ready-to-fire condition with safety 200 in the "safety off" position. Accordingly, as shown in FIGS. 24B and 25B, lever 202 of safety 200 may further include a hole 210 which must be concentrically aligned with keyhole 211 in frame 30 (see FIG. 1A) to allow the user access with a key (not shown) to key engagement aperture 164 of lock pin 160. When safety 200 is in the "safety off" position shown in FIG. 24B, hole 210 in safety 200 is positioned below key engagement aperture 164 behind a portion of lever 202 so that a user cannot insert a key into lock pin 160. When safety 200 is moved to the "safety on" position shown in FIG. 25B, hole 210 in the safety is concentrically aligned with both keyhole 211 in frame 30 and key engagement aperture 164. This now allows the user to insert a key into lock pin 160 and lock the safety in the "safety on" position in the manner described above.

To unlock the firearm 20, the user inserts the key into the firearm to engage lock pin 160 and rotate the lock pin back to the "unlocked" position shown in FIGS. 24A&B. This retracts blocking surface 300 from slot 209 and locking protrusion 206 can now move freely again past lock pin 160 thereby allowing the user to lower safety 200 back to the "safety off" position as also shown in FIGS. 24A&B.

In one embodiment, safety 200 further provides a means for preventing firing control housing mounting cross-pin 95 from being removed when the safety is in the "safety on" position as shown in FIGS. 25A&B. Referring to FIGS. 24A&B and 25A&B, safety 200 may include a semi-circular cutout 196 on a front portion that preferably is configured to complement the shape and size of mounting cross-pin head 99 shown in FIGS. 15-17. As shown, mounting cross-pin 95 includes a slot 97*b* in which lever 202 travels when the mounting cross-pin is inserted in pistol 20. As shown in FIGS. 25A&B when safety 200 is in the activated "safety on" position, lateral removal of cross-pin 95 from pistol frame 30 is prevented by a front portion of the safety lever 202 that engages shaft 98 adjacent to slot 97*b* and prevents the mounting cross-pin from being removed. To remove mounting cross-pin 95 from pistol 20, safety 200 is placed in the downward "safety off" position shown in FIGS. 24A&B. This aligns cutout 196 with cross-pin 95 so that the pin can now be removed provided the ejector 130 is in the correct position with pin 95 located in central portion 156 of ejector slot 155.

According to another aspect of the preferred embodiment, pistol 20 further includes a reversible backstrap that allows the user to alter the grip size and type of backstrap. FIGS. 28-33 illustrate the grip frame 32 which defines a grip of pistol 20 and a reversible backstrap, which in one embodiment may be in the form of a backstrap insert 180 that is reversible in position and orientation to alternate between two backstrap grip surfaces. With initial reference to FIGS. 28A&B and 29, pistol 20 in one embodiment may include an elongated backstrap cavity 181 which is configured to slidably receive and complement the shape of backstrap insert 180. Cavity 181 may preferably be formed in the rear of grip frame 32 adjacent to the rear of magazine cavity 36 behind rear wall 35. In one possible embodiment as shown, the bottom 310 of backstrap cavity 181 preferably is open to allow backstrap insert 180 to be inserted into the cavity from the bottom of grip frame 32. The rear of backstrap cavity 181 opens to form a rear-facing window 312 (see FIG. 29) to allow a grip surface of backstrap 180 to project outwards from the cavity as explained below.

Figure 28A:
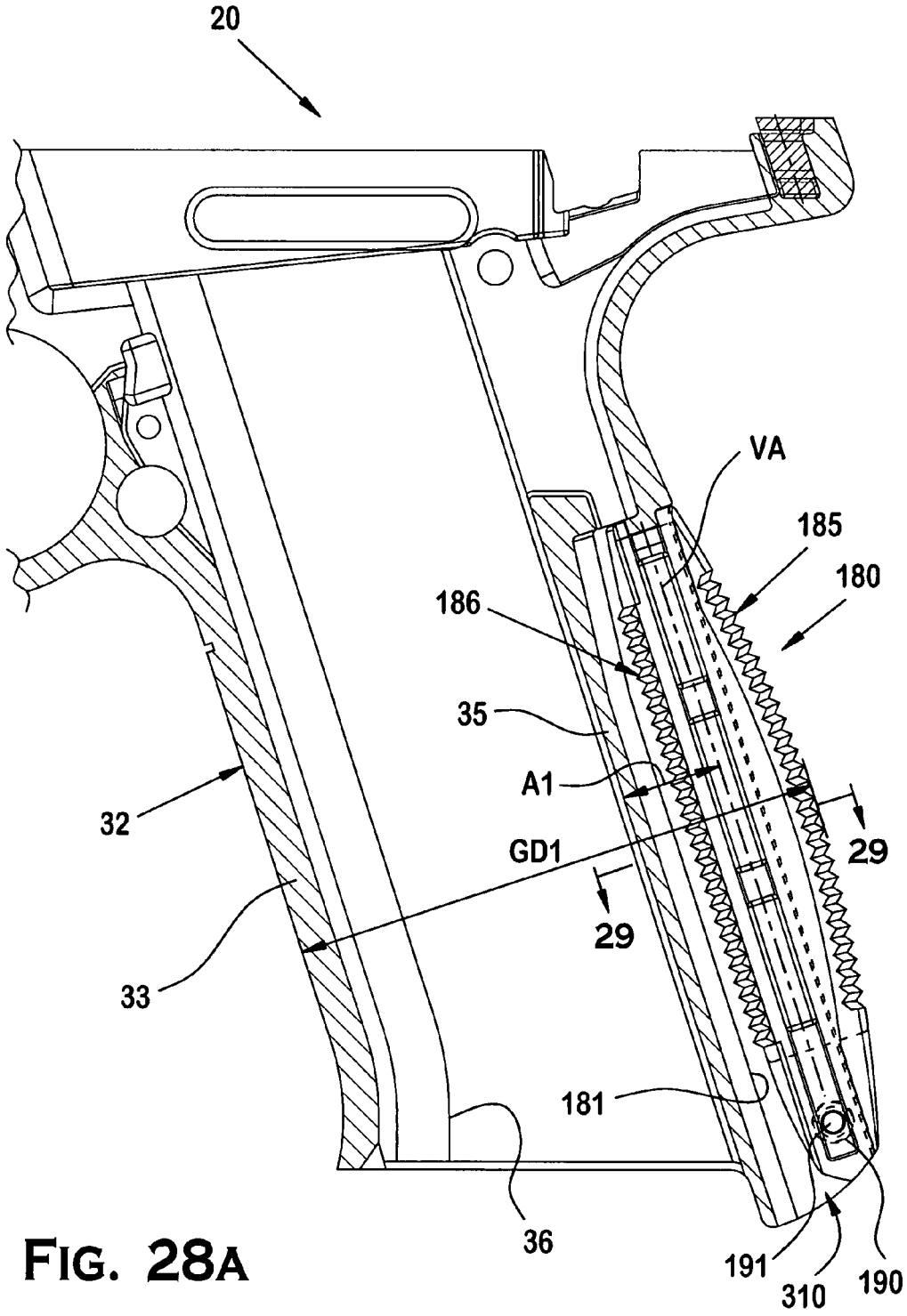
FIG. 28A is a partial side cross-section of the grip frame of the pistol of FIG. 1 showing a reversible backstrap insert in a first installed position.
Figure 32:
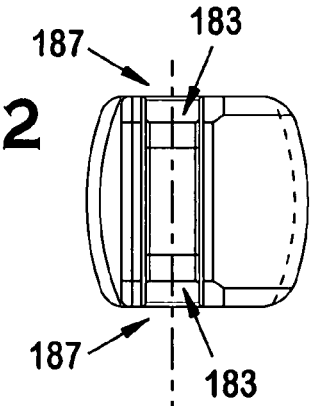
FIG. 32 is a top end view of the reversible backstrap insert shown in FIG. 31.
Figure 33:
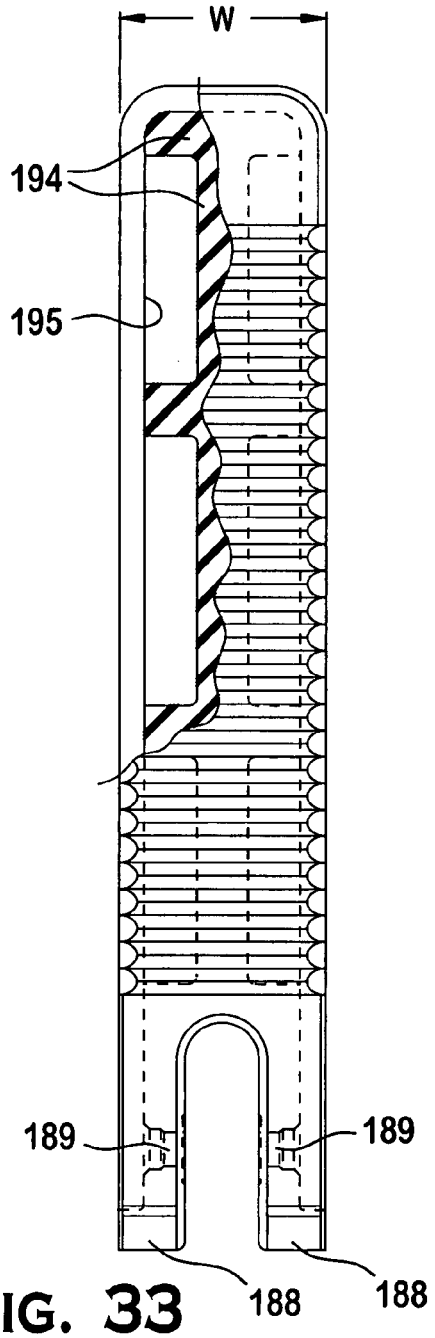
FIG. 33 is a rear view with partial cross-section of the reversible backstrap insert of FIG. 31.
Figure 31:
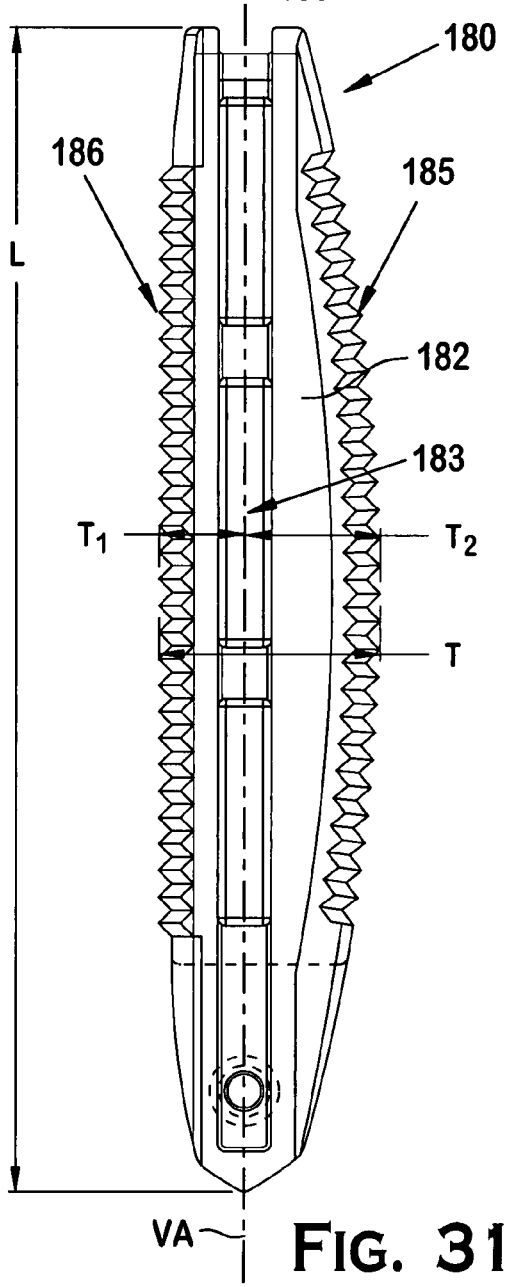
FIG. 31 is a side view of the reversible backstrap insert of FIGS. 28A&B.
Figure 34:
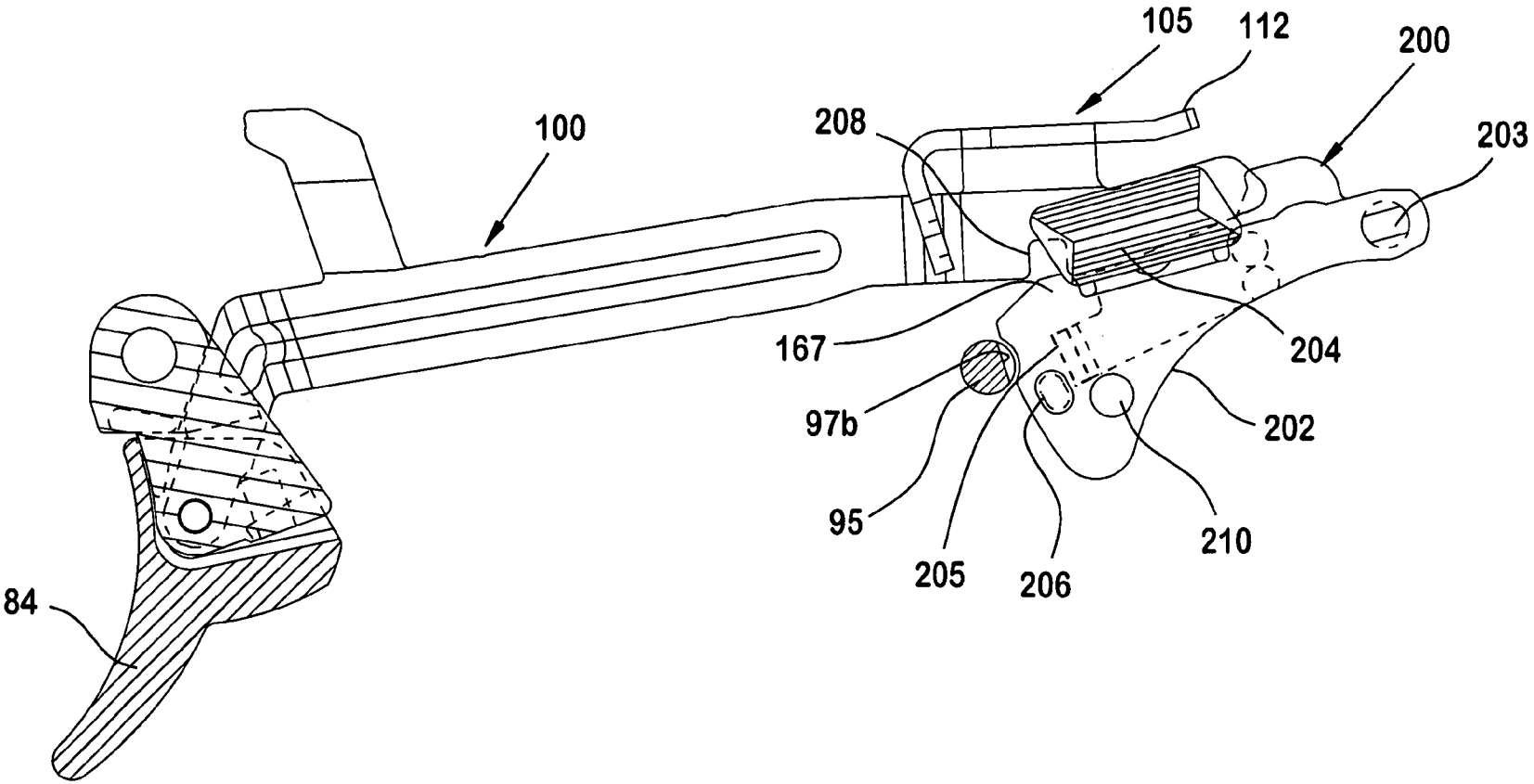
FIG. 34, is a side view of the trigger bar assembly of the pistol of FIG. 1 showing the safety disengaged from the trigger bar in a "safety off" position.
Figure 35:
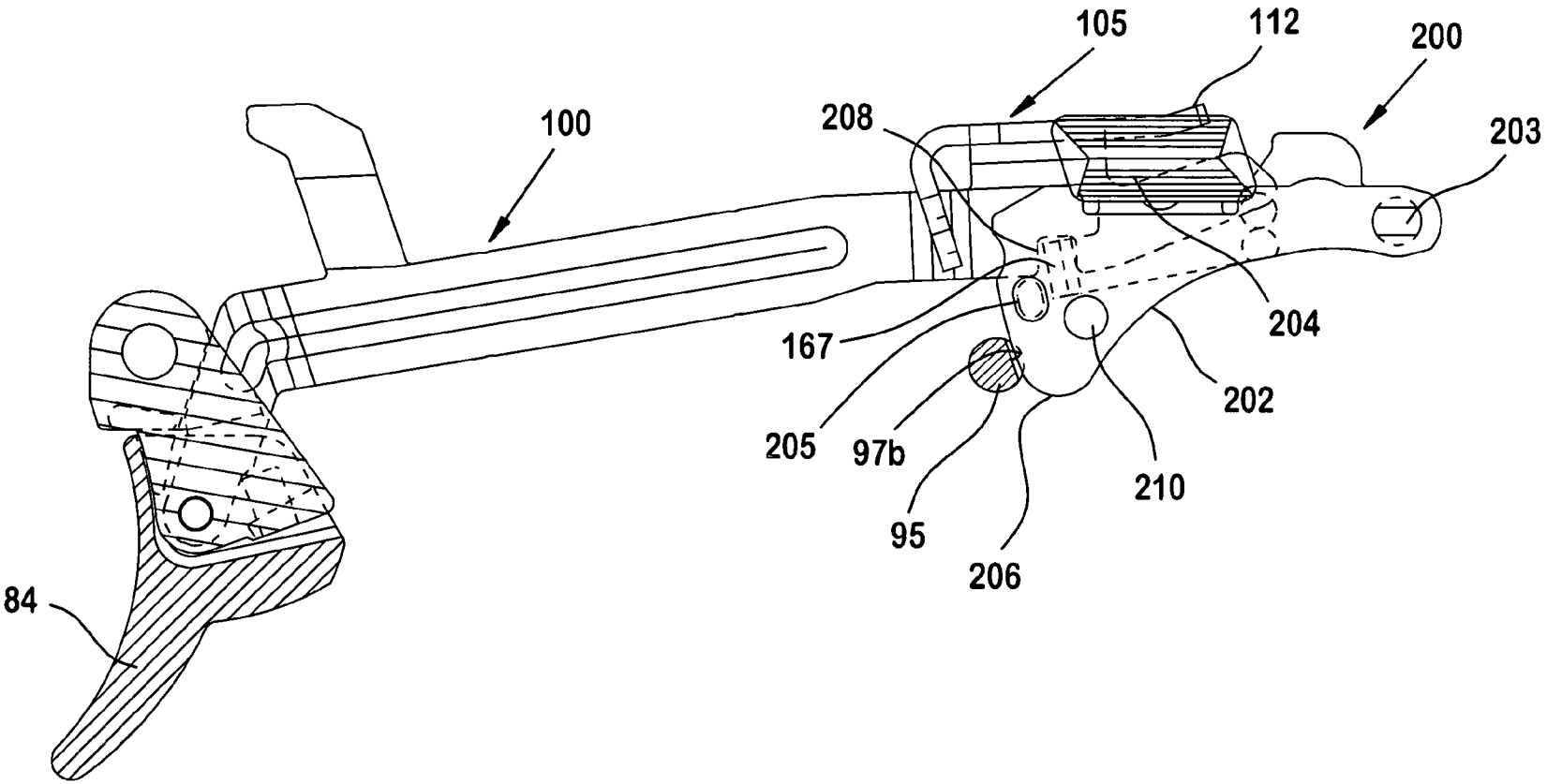
FIG. 35 is a side view of the trigger bar assembly of the pistol of FIG. 1 showing the safety engaged from the trigger bar in a "safety on" position.

Referring to FIGS. 31-33, backstrap insert 180 in one embodiment includes an elongate body 182 having a pair of spaced-apart elongated recesses such as channels 183 disposed on opposite sides 187 of the backstrap insert. Channels 183 are configured to receive and complement in shape and size a pair of spaced-apart elongate backstrap guide members such as ribs 184 formed in grip frame 32 inside backstrap cavity 181 (see FIG. 29). Ribs 184 extend in a forward angled orientation on opposite sides of cavity 181 as shown in FIGS. 28A&B and 29. Backstrap body 182 defines a vertical axis VA, which in one embodiment coincides with a centerline of the backstrap insert. Backstrap insert 180 further defines a total thickness T, width W, and length L. In some representative typical embodiments, backstrap insert 180 may have a thickness-to-width T:W ratio of at least about 0.75:1, and more preferably at least about 1:1. As shown in FIG. 33, stiffeners 194 may optionally be formed in channels 183 to help the channels retain their open shape and facilitate smooth sliding along ribs 184 when backstrap 180 is inserted or removed from grip frame 32. The stiffeners may be preferable especially if the backstrap insert 180 is made from a pliable or elastomeric material. In other embodiments, backstrap insert 180 may be provided without stiffeners 194.

Backstrap insert 180 further includes a first portion defining a first backstrap grip surface 185 and an opposite second portion defining a second backstrap grip surface 186. In one embodiment, the first portion may be a front portion and the second portion may be a rear portion of backstrap insert 180. Opposite backstrap grip surfaces 185 and 186 preferably each face outwards from backstrap insert 180 and advantageously provide the user with a choice of two different grip sizes and/or types of grip surfaces. Preferably, grip surfaces 185, 186 differ from each other in characteristics such as thicknesses, side contour or profile, surface textures, and/or type of material. In some preferred embodiments, either one or both of backstrap grips 185, 186 may optionally have textured surfaces (e.g., vertical and/or horizontal ribbing or serrations; checkering, dimpling, pebbling, etc.) for slip resistance when gripped by the user. However, either one or both of backstrap grip surfaces 185, 186 may also be smooth in other embodiments to suit user preferences.

With continuing reference to FIGS. 31-33, backstrap grips 185, 186 preferably each have different side profiles or contours to provide two different grip sizes to the user. In one possible embodiment as shown, backstrap grip surface 186 may be substantially flat or straight in side profile (excluding any applied or formed surface textures) while backstrap grip surface 185 may be substantially convex or bulbous. In other embodiments, backstrap grips 185, 186 may be concave in side profile. In yet other embodiments, backstrap grip surface 185 may be slightly convex or bulbous and grip surface 186 may be more convex or bulbous than grip surface 185. The sizes and profiles of grip surfaces 185, 186 allow the user to adjust the overall grip depth between a first grip depth GD1 (see FIG. 28A) and a second grip depth GD2 (see FIG. 28B) by changing the position of backstrap insert 180 in pistol 20 to change the orientation of the grip surfaces. In a preferred embodiment, grip depth GD1 is different than GD2.

Total thickness T of backstrap insert 180 may be defined as the sum of a first thickness T1 defined by grip surface 185 and measured from vertical axis VA to grip surface 186, and a second thickness T2 defined by grip surface 185 and measured from vertical axis VA to grip surface 185, both as shown in FIG. 31. Preferably, T1 is different that T2 so that depending on whether backstrap grip surface 185 or 186 is oriented facing rearwards, overall grip depth GD1, GD2 may be varied in size between a small grip size and a larger grip size. Accordingly, in one embodiment, T2 preferably is greater than T1. A distance A1 may be defined between the front surface of rear wall 35 of magazine cavity 36 and vertical axis VA of backstrap insert 180 (which also coincides with the centerline of ribs 184 of grip frame 32 best shown in FIG. 29). Since distance A1 remains fixed regardless of the position of backstrap insert 180, the sum of distances A1+T1 or A1+T2 preferably may be different and varied by the user to change the overall grip depth GD1, GD2 depending on whether grip surfaces 185 or 186 are facing rearwards based on the installed position of backstrap insert 180.

Figure 28B:
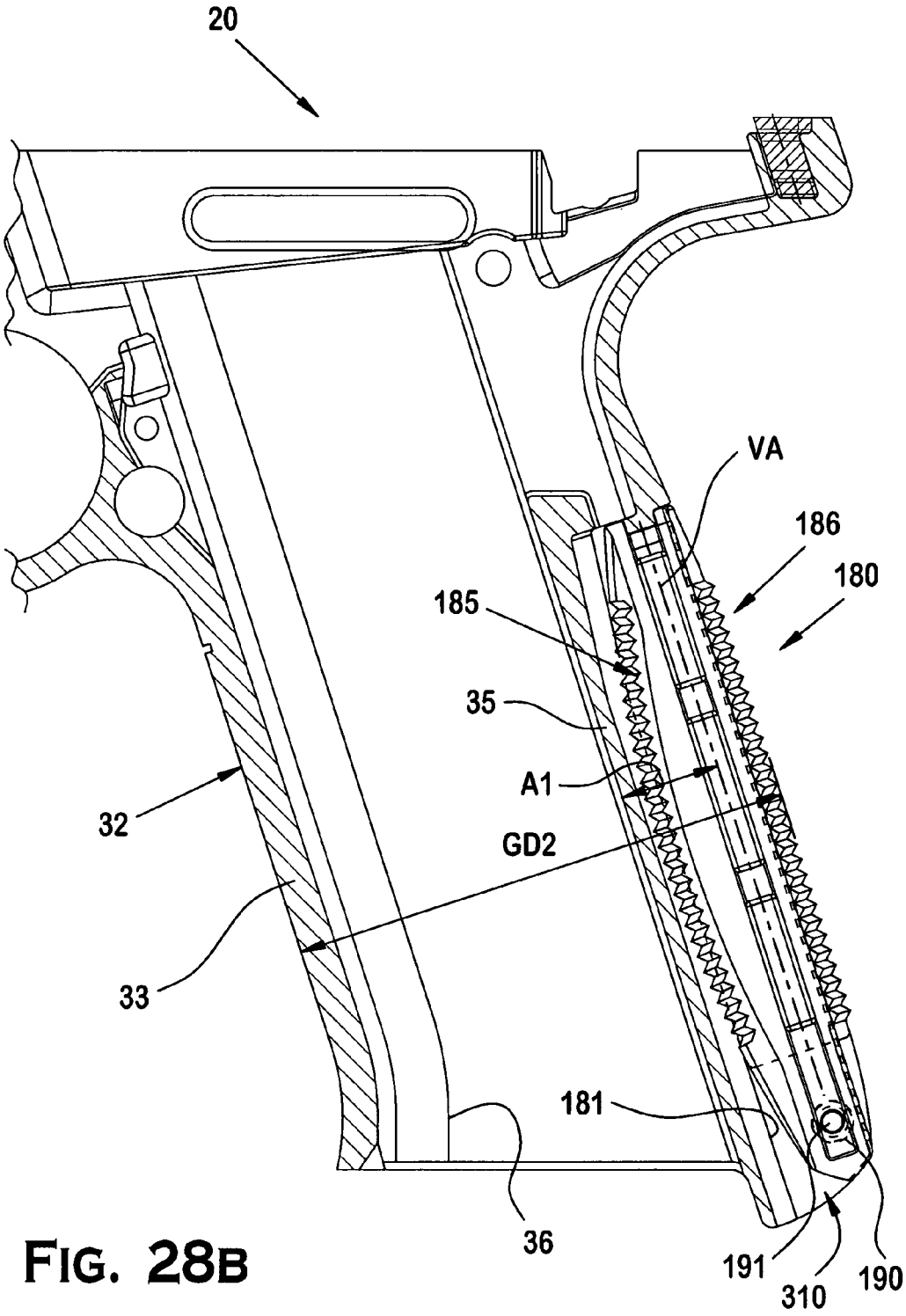
FIG. 28B is a partial side cross-section of the grip frame of the pistol of FIG. 28A showing the reversible backstrap insert in a second installed position.
Figure 29:
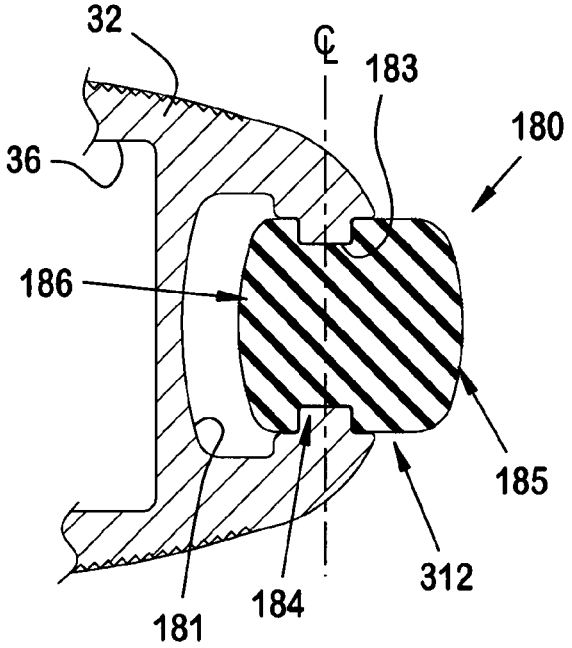
FIG. 29 is a cross-section taken along line 29-29 in FIG. 28A.
Figure 30:
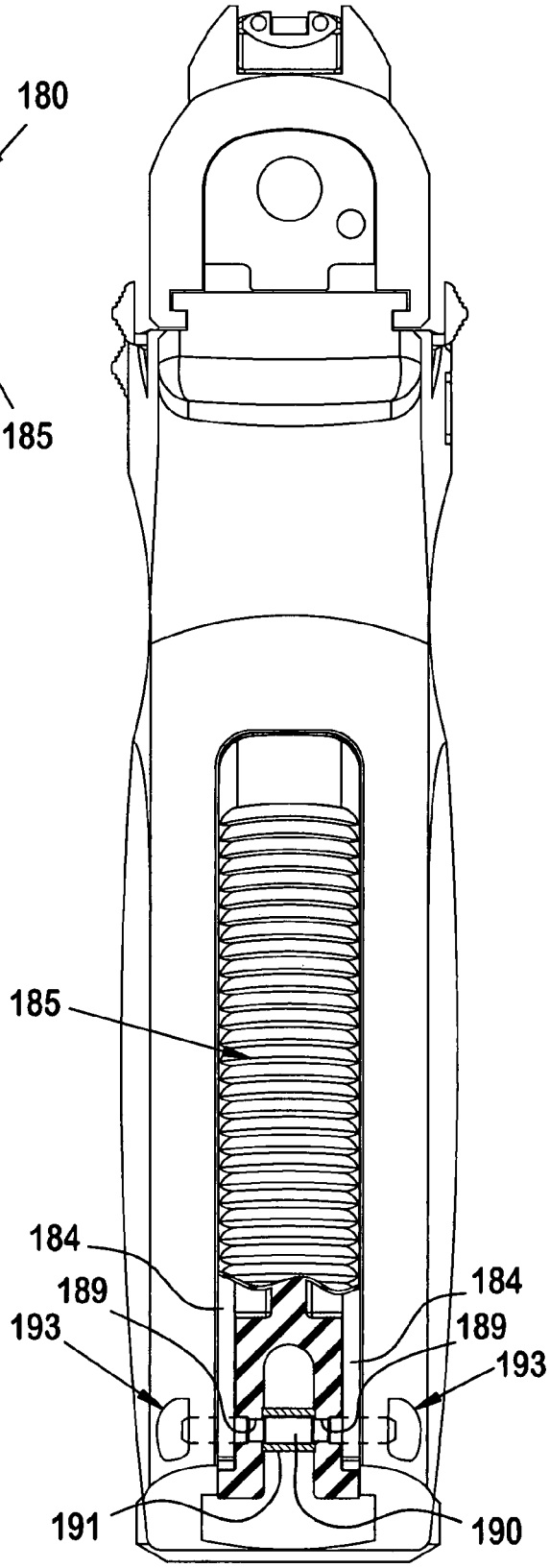
FIG. 30 is a rear partial cross-section of the pistol of FIG. 1 showing the backstrap insert.

Preferably, the side contour or profile of the top of backstrap grip surfaces 185, 186 is formed to match the contour of the rear portion of pistol grip frame 32 immediately above the backstrap insert to form a smooth transition for the comfort of the user, as shown in FIGS. 28A and 28B. The contour or profile of the bottom of backstrap grip surfaces 185, 186 may also be formed to match the contour of the rear portion of pistol grip frame 32 immediately below the backstrap insert 180.

In one embodiment, backstrap insert 180 further includes a pair of spaced-apart ears or prongs 188 which may be formed on a lower portion of the backstrap insert and project vertically downwards. Each prong 188 includes a backstrap hole 189 configured to receive a fastener such as backstrap retaining pin 190, which pin is further received in two holes 193 formed in opposite sides of grip frame 32 (see, e.g., FIG. 30). Holes 193 preferably are through-holes so that retaining pin 190 may be driven out from either side of grip frame 32 by a user to remove backstrap insert 180 from the pistol. A bushing 191 may be provided to serve as a spacer for keeping prongs 188 in a spaced-apart relationship when backstrap insert 180 is mounted in grip frame 32 (see, e.g., FIG. 30). In other embodiments (not shown), prongs 188 may be omitted and the bottom of backstrap insert 180 may be solid from side-to-side.

It should be noted that other suitable means and configurations of backstrap insert 180 may be used to retain the backstrap insert in pistol 20 so long as backstrap insert 180 is removably attached to pistol 20. Accordingly, the invention is not limited to the user of retaining pins for securing backstrap insert 180 in pistol 20.

Backstrap insert 180 may be made of any suitable material, including without limitation an elastomer or rubber, plastic, metal, composite, wood, combinations thereof, or any other suitable materials that may commonly be used to fabricate backstraps for pistol grips. Therefore, backstrap insert 180 not only allows a user to choose from two different grip sizes, but also from two different types of grip materials and/or surface textures such as ribbed, knurled, dimpled, smooth, etc. According to other embodiments contemplated, therefore, backstrap insert 180 may have a smooth grip surface 185 on one portion and another type of surface texture on opposite grip surface 186 on another portion. Either one or both backstrap grip surfaces 185, 186 may additionally be flat, convex, concave, or combinations thereof in side profile. In addition, grip surfaces 185, 186 may further be provided in various color combinations for aesthetic reasons and/or to distinguish between various grip sizes. Thus any number of combinations of grips is possible by varying the types of materials, surface textures, colors, and/or sizes with a reversible backstrap insert 180 according to the preferred embodiment.

Use of reversible backstrap insert 180 will now be described. Backstrap insert 180 may be installed in grip frame 32 and positioned in backstrap cavity 181 in at least two different and reversible positions, as illustrated by FIGS. 28A and 28B. In FIG. 28A, backstrap insert 180 has been positioned in cavity 181 of pistol 20 in a first position with convex backstrap grip surface 185 being exposed to a user and oriented facing outward and rearward through window 312. Grip surface 185 defines a first grip depth GD1 measured from the front surface of front wall 33 of grip frame 32 to rear grip surface 185. Flat backstrap grip surface 186, which is disposed on the opposite front portion of backstrap insert 180, is concealed and oriented in backstrap cavity 181 facing forward and inward as shown. Grip surface 186 therefore does not contribute to or affect grip depth GD1 in this orientation. The first position of backstrap insert 180 and first orientation of grip surfaces 185, 186 as shown in FIG. 28A would accommodate a user with a preference for a larger or deeper pistol grip.

In order to change the grip depth and make the pistol grip smaller, the user first pushes or drives retainer pin 191 out from grip frame 32 using a suitable tool (e.g., a punch, etc.). Backstrap insert 180 is then slid downwards in backstrap cavity 181 and removed through the open bottom 310 of backstrap cavity 181 in grip frame 32. The orientation of backstrap insert 180 is reversed by rotating the insert 180 degrees about the backstrap vertical axis VA passing through the insert so that flat backstrap grip 186 now faces rearward and convex grip surface 185 faces forward. The user reinstalls backstrap insert 180 back up into backstrap cavity 181 by first aligning channels 183 of the backstrap insert with ribs 184 on grip frame 32, and then sliding the backstrap insert upwards until fully seated in the cavity. Once backstrap insert 180 is fully seated, retaining pin 190 may now be reinserted back through now concentrically aligned holes 193 in grip frame 32 and holes 189 in the backstrap insert, with bushing 191 preferably positioned between prongs 188. Backstrap insert 180 is now in a second position in cavity 181 shown in FIG. 28B with flat backstrap grip surface 186 now being exposed to the user and oriented facing rearward and projecting through window 312. Grip surface 186 defines a second grip depth GD2, which in one embodiment is preferably smaller than grip depth GD1. The second position of backstrap insert 180 and second orientation of grip surfaces 185, 186 as shown in FIG. 28B would accommodate a user with a preference for a smaller or shallower pistol grip. Convex backstrap grip surface 185 is now concealed and oriented in backstrap cavity 181 facing forward and inward as shown, which is opposite in direction prior to rotating the backstrap insert 180. Grip surface 185 therefore does not contribute to or affect grip depth GD2 in this second orientation.

In contrast to known replaceable backstraps which are provided as multiple separate units that must be carried separately with the pistol and therefore can easily become misplaced and lost, a single reversible backstrap insert 180 according to the preferred embodiment advantageously provides a user with two different pistol grip sizes and/or types as described above with a component that forms a standard part of the pistol and thus is always carried with the pistol user into the field. Therefore, backstrap insert 180 provides a more convenient way for a user to alter the grip size and/or type without the need to carry separate pieces into the field.

Although the reversible backstrap has been described for convenience with reference to a firearm in the form of a pistol, it will be appreciated that the backstrap may be used with any type of firearm or weapon having a pistol-type grip. More broadly, the reversible backstrap may be used with any type of apparatus or device where it is desirable to have the ability to easily change the size, shape, texture, and/or color of the hand-grip, such as without limitation tools, medical devices, etc. Accordingly, the reversible backstrap is not limited in its applicability to either pistols or firearms in general.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes and/or control logic as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A firearm with reversible grip backstrap comprising:

a firearm frame defining a grip and a cavity; and a backstrap insert removably positioned in the cavity, the backstrap including a first grip surface and a second grip surface, wherein the position of the backstrap in the cavity is reversible to alternate orientation of the first and second grip surfaces.

2. The firearm of claim 1, wherein the backstrap has a first position in which the first grip surface is oriented to face forward and the second grip surface is oriented to face rearward.

3. The firearm of claim 1, wherein the second grip surface projects rearward and outwards from the cavity.

4. The firearm of claim 3, wherein the first grip surface faces forward and inwards towards the cavity.

5. The firearm of claim 1, wherein the backstrap insert has an asymmetrical shape defined by the first and second grip surfaces.

6. The firearm of claim 1, wherein the first and second grip surfaces are disposed on opposite front and rear portions of the backstrap insert respectively.

7. The firearm of claim 1, wherein the first and second grip surfaces define respective different thicknesses, the first and second grip surfaces having a first orientation when the backstrap is positioned in the firearm frame defining a first grip depth.

8. The firearm of claim 7, wherein the first and second grip surfaces have a second orientation when the backstrap is positioned in the firearm frame defining a second grip depth different than the first grip depth.

9. The firearm of claim 1, wherein the first grip surface is convex in profile and the second grip surface is substantially flat in profile.

10. The firearm of claim 1, wherein the first grip surface is ribbed or serrated.

11. The firearm of claim 1, wherein the backstrap is made of an elastomeric material.

12. A firearm with reversible grip backstrap comprising:

a firearm frame defining a grip and a cavity; and a backstrap including a first grip surface and a second backstrap grip surface disposed on opposite portions of the backstrap, the first grip surface being different than the second grip surface, the backstrap removably positioned in the cavity and defining a first orientation wherein the first grip surface faces forward and the second grip surface faces rearward;

wherein reversing the position of backstrap in the cavity defines a second orientation wherein the first grip surface faces rearward and the second grip surface faces forward.

13. The firearm of claim 12, wherein the backstrap in the second orientation is rotated 180 degrees from the first orientation.

14. The firearm of claim 12, wherein the first grip surface is convex in profile and the second grip surface is substantially flat in profile.

15. The firearm of claim 12, wherein the first and second orientations each define respective first and second grip depths, the second grip depth being different than the first grip depth.

16. The firearm of claim 12, wherein the firearm frame defines a pair of spaced-apart ribs in the cavity that are adapted to slidably receive a pair of spaced-apart channels in the backstrap.

17. The firearm of claim 12, wherein the first and second grip surfaces define respective different thicknesses, the first orientation of the backstrap in the cavity defining a first grip depth.

18. The firearm of claim 17, wherein the second orientation of the backstrap in the cavity defines a second grip depth different than the first grip depth.

19. The firearm of claim 18, wherein the second grip depth is smaller than the first grip depth.

20. A firearm with reversible backstrap comprising:

a firearm grip frame having a depth and defining a cavity; and a backstrap removably positioned in the cavity in a first position, the backstrap including a first grip surface and a second grip surface disposed on opposite front and rear portions of the backstrap respectively, the first grip surface defining a first side profile and a first thickness and the second grip surface defining a second side profile and a second thickness different than the first thickness, wherein reversing the position of the backstrap in the cavity to a second position changes a combined depth of the firearm grip frame and backstrap.

21. The firearm of claim 20, wherein the first grip surface is convex in profile and the second grip surface is substantially flat in profile.

22. The firearm of claim 20, wherein when the backstrap is in the first position in the cavity, the first grip surface faces forward and the second grip surface faces rearward, and wherein when the backstrap is in the second position in the cavity, the first grip surface faces rearward and the second grip surface faces forward.

23. The firearm of claim 22, wherein the combined depth of the firearm grip frame and backstrap is measured from a front surface of the firearm grip frame to the second grip surface defining a first grip depth when the backstrap is in the first position, and wherein the combined depth of the firearm grip frame and backstrap is measured from the front surface of the firearm grip frame to the first grip surface defining a second grip depth when the backstrap is in the second position, the first grip depth being different than the second grip depth.

24. The firearm of claim 20, wherein the first backstrap grip surface has a texture different than the second grip surface.

* * * * *

UNITED STATES PATENT AND TRADEMARK OFFICE

CERTIFICATE OF CORRECTION

PATENT NO. : 7,827,719 B2
APPLICATION NO. : 11/881111
DATED : November 9, 2010
INVENTOR(S) : James McGarry It is certified that error appears in the above-identified patent and that said Letters Patent is hereby corrected as shown below:

Column 20, line 47, delete “insert”.

Column 20, line 60, delete “insert”.

Column 20, line 65, delete “insert”.

Column 21, line 18, delete “backstrap”.

Column 22, line 41, delete “backstrap”.

Signed and Sealed this
Tenth Day of May, 2011

David J. Kappos

David J. Kappos
*Director of the United States Patent and Trademark Office*